US005391828A

United States Patent [19]

Tajima

[11] Patent Number: 5,391,828

[45] Date of Patent: Feb. 21, 1995

[54] IMAGE DISPLAY, AUTOMATIC PERFORMANCE APPARATUS AND AUTOMATIC ACCOMPANIMENT APPARATUS

[75] Inventor: Youichiro Tajima, Kunitachi, Japan

[73] Assignee: Casio Computer Co., Ltd., Tokyo, Japan

[21] Appl. No.: 971,249

[22] Filed: Nov. 3, 1992

Related U.S. Application Data

[63] Continuation of Ser. No. 771,408, Oct. 2, 1991.

[30] Foreign Application Priority Data

Oct. 18, 1990 [JP] Japan ..... 2-279923
Nov. 5, 1990 [JP] Japan ..... 2-299544
Nov. 5, 1990 [JP] Japan ..... 2-299545

[51] Int. Cl.[6] ..... G10G 1/00

[52] U.S. Cl. ..... 84/601; 84/610; 84/645; 84/464 R

[58] Field of Search ..... 84/636, 601–614, 84/645, 464 R, 477 R; 395/152, 154, 155, 159, 161

[56] References Cited

U.S. PATENT DOCUMENTS 4,534,257 8/1985 Mitarai ..... 84/DIG. 12
4,641,253 2/1987 Mastran ..... 364/518
4,698,770 10/1987 Rattan et al. ..... 364/900
4,753,148 6/1988 Johnson ..... 84/464 R
4,757,736 7/1988 Tajima ..... 84/DIG. 12
4,771,671 9/1988 Hoff, Jr. ..... 84/453 X
4,876,937 10/1989 Suzuki ..... 84/612
4,936,184 6/1990 Yang ..... 84/612
4,945,804 8/1990 Farrand ..... 84/484 X
4,969,384 11/1990 Kawasahi et al. ..... 84/612
5,038,660 8/1991 Watanabe ..... 84/601
5,048,390 9/1991 Adashi et al. ..... 84/464 R
5,111,409 5/1992 Gasper et al. ..... 395/152
5,119,474 6/1992 Beitel et al. ..... 395/154
5,148,154 9/1992 Mackay et al. ..... 340/712
5,164,529 11/1992 Saito ..... 84/636 X
5,233,438 8/1993 Funahashi et al. ..... 358/341
5,247,126 9/1993 Okamura et al. ..... 84/609
5,250,747 10/1993 Tsumura ..... 84/645
5,286,909 2/1994 Shibukawa ..... 84/612 X

FOREIGN PATENT DOCUMENTS 58-55988 4/1983 Japan .
59-90999 6/1984 Japan .
60-154387 8/1985 Japan .
60-188994 9/1985 Japan .
63-170697 7/1988 Japan .
64-43398 3/1989 Japan .
64-44435 3/1989 Japan .
64-57298 3/1989 Japan .
1-205781 8/1989 Japan .

*Primary Examiner*—William M. Shoop, Jr.
*Assistant Examiner*—Brian Sircus
*Attorney, Agent, or Firm*—Frishauf, Holtz, Goodman & Woodward

[57] ABSTRACT

A plurality of image data and sequence data indicative of the sequence of displaying images are provided beforehand. The image data are sequentially read in accordance with the sequence indicated by the sequence data at the timing synchronous with automatic accompaniment. Image advancement in automatic accompaniment of a normal pattern differs from image accompaniment in automatic accompaniment of a fill-in pattern. The image display is made at the timing synchronous with chord advancement in automatic accompaniment.

14 Claims, 27 Drawing Sheets

| |
|---|
| RHYTHM #1 |
| RHYTHM #2 |
| RHYTHM #3 |
| RHYTHM #4 |
| RHYTHM #5 |
| RHYTHM #6 |

| |
|---|
| RHYTHM #1 |
| RHYTHM #2 |
| RHYTHM #3 |
| RHYTHM #4 |
| RHYTHM #5 |
| RHYTHM #6 |

PICTURE #1

PICTURE #2

PICTURE #3

PICTURE #4

PICTURE #5

PICTURE #6

PICTURE #7

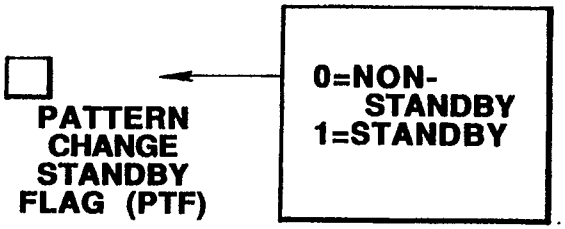
FIG. 21(g)
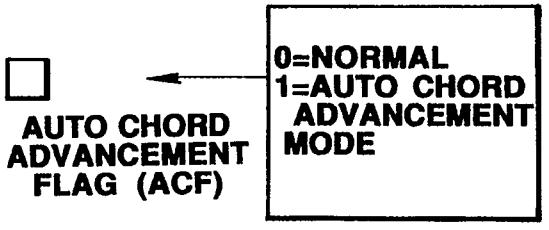
FIG. 21(h)
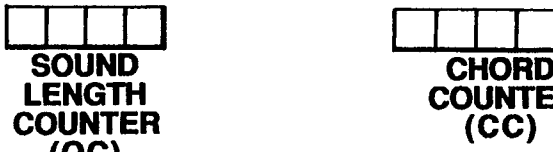
FIG. 21(j)
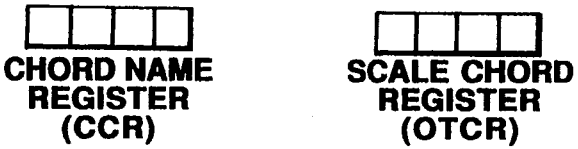
FIG. 21(l)
FIG. 21(i)
FIG. 21(k)
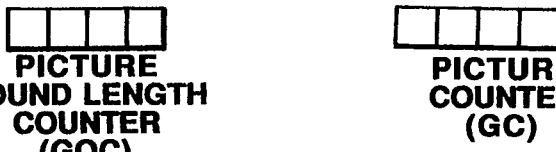
FIG. 21(n)
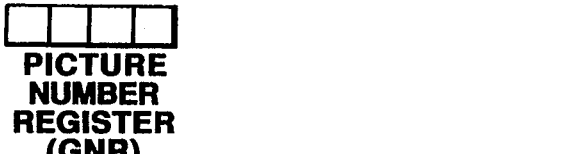
FIG. 21(o)
FIG. 21(m)

| TEMPO DATA TD | TEMPO |
|---|---|
| 0 0 0 0 0 | 0 |
| 0 0 0 0 1 | 1 |
| 0 0 0 1 0 | 2 |
| 0 0 0 1 1 | 3 |
| ⋮ | ⋮ |

| | PICTURE NUMBER DATA (GD) | PICTURE SOUND LENGTH DATA (GOD) |
|---|---|---|
| INITIAL PICTURE | #1 | |
| STEP 0 | #3 | 1 |
| 1 | #4 | 1 |
| 2 | #3 | 1 |
| 3 | #4 | 4 |
| 4 | #5 | F |
| 5 | — | |
| 6 | — | — |
| 7 | — | — |

FIG. 27(A)

| | | |
|---|---|---|
| STEP 0 | #5 | — |
| | #5 | — |
| | #3 | — |
| | #3 | — |
| 4 | #5 | — |
| | #3 | — |
| | #5 | — |
| | #4 | — |
| 8 | #3 | — |
| | #3 | — |
| | #3 | — |
| | #3 | — |
| 12 | #5 | — |
| | #4 | — |
| | #5 | — |
| 15 | #3 | — |

FIG. 27(B)

| | PICTURE NUMBER DATA (GD) | PICTURE SOUND LENGTH DATA (GOD) |
|---|---|---|
| INITIAL PICTURE | #2 | |
| STEP 0 | #6 | 8 |
| 1 | #6 | 8 |
| 2 | #7 | 8 |
| 3 | #7 | 8 |
| 4 | #7 | 8 |
| 5 | #7 | 8 |
| 6 | — | F |
| 7 | — | — |
| ⋮ | ⋮ | ⋮ |
| 31 | — | — |

IMAGE DISPLAY, AUTOMATIC PERFORMANCE APPARATUS AND AUTOMATIC ACCOMPANIMENT APPARATUS

This application is a continuation of application Ser. No. 07/771,408, filed Oct. 2, 1991.

BACKGROUND OF THE INVENTION

The present invention relates to image display apparatus which provide a feeling of play from a visual standpoint, using a memory of a small capacity, an apparatus which performs an automatic performance or accompaniment on the basis of a pattern stored previously in a memory, and more particularly to such apparatus which provides an animation display synchronized with the advancement of an automatic performance or accompaniment, using a memory of a small capacity.

The diffusion of electronic musical instruments such as electronic keyboards, electronic wind instruments, electronic stringed instruments allows us to easily enjoy various kinds of musical sounds. In addition, a single electronic musical instrument can easily provide various kinds of musical sounds.

In order to provide performance effects full of variety by simple operations, many electronic instruments with an automatic accompaniment unit have been developed.

In this case, the aspect of an automatic accompaniment includes an automatic accompaniment using a rhythm musical instrument sound, an automatic accompaniment using an accompaniment of bass and chord, etc., to thereby improve a musical presentation.

The automatic accompaniment includes iteration of a kind of rhythm, for example, iteration of a given accompaniment pattern such as rock, waltz or march. In an automatic accompaniment device which performs an automatic accompaniment of bass and chord, the timing of generating a chord sound is designated, for example, by a pattern of a set of 16 steps corresponding to a sixteenth note (hereinafter referred to as a chord pattern). Namely, it is determined whether a chord sound is generated at each step, chord patterns of 16 steps are sequentially read out at constant tempo, it is determined and controlled whether a chord sound is to be generated at each step while the timing of generating the chord sound is being controlled, and these chords are performed while repeatedly reading the 16 steps, which produces a musically rhythmical accompaniment effect.

At this time, how to designate chord sounds advanced and generated in the chord pattern or how to designate the kind of a chord to the advancement of a melody is made by the performer, by using a particular key region on the keyboard (hereinafter referred to as the accompaniment key) when required, or is made by automatic accompaniment on the basis of the chord advancement beforehand stored by the performer into a predetermined chord memory.

The instrument body has an ending switch and a fill-in switch. If the ending switching is operated, the pattern of an automatic accompaniment which has been played at that time is switched to the ending pattern. If the fill-in switch is operated, the pattern of an automatic accompaniment pattern which has been played at that time is switched to the fill-in pattern. If the fill-pattern ends, the automatic accompaniment of the original accompaniment pattern again starts. Therefore, the user of this instrument obtains automatic accompaniment to the composition of a melody to be played by operating the ending switch and/or fill-in switch.

Since the automatic accompaniment apparatus plays the automatic accompaniment of a rhythm musical instrument sound, bass and chord using the designated chord or chords based on data on the beforehand stored chord advancement, it provides an acoustic feeling of play in any accompaniment pattern and chord advancement. However, a visual feeling of play cannot be obtained.

As mentioned above, the conventional automatic accompaniment apparatus only changes the accompaniment pattern by operating the switches, so that automatic accompaniment to the composition of a melody provides an acoustic feeling of play, but not a visual feeling of play.

SUMMARY OF THE INVENTION

It is a first object of the present invention to provide an image display apparatus which provides a feeling of play from a visual standpoint, by only using a memory of a small capacity.

It is a second object of the present invention to provide an automatic performance apparatus which supplies by automatic accompaniment the user with not only an acoustic feeling of play but also a visual feeling of play synchronized with the acoustic feeling of play, by only using a memory of a small capacity.

It is a third object of the present invention to provide an automatic accompaniment apparatus which is capable of displaying animations corresponding to a plurality of accompaniment patterns, by using a memory of a small capacity.

It is a fourth object of the present invention to provide an automatic accompaniment apparatus which is capable of displaying animations corresponding to a plurality of accompaniment patterns switched, using a memory of a small capacity.

It is a fifth object of the present invention to provide an automatic accompaniment apparatus which is capable of displaying animations corresponding to a plurality of accompaniment patterns or chord advancement, using a memory of a small capacity.

The first object is achieved by an image display apparatus comprising:

- image data storing means for storing a plurality of image data each of which represents the corresponding images;
- image data reading means for reading the image data from said image data storing means;
- sequence data storing means for storing sequence data indicative of the sequence in which the image data are read by said image data reading means;
- controlling means for controlling said image data reading means so as to read the image data in accordance with the sequence indicated by the sequence data stored in the sequence data storing means; and
- displaying means for displaying the image which the image data read by said image data reading means represents.

The second object is achieved by an automatic performance apparatus comprising:

- musical data storing means for storing musical data representing music;

automatic performance means for perform the music automatically by reading the musical data from said musical data storing means;

image data storing means for storing a plurality of image data each of which represents the corresponding images;

image data reading means for sequentially reading the image data from said image data storing means at the timing synchronous with advancement of the music;

sequence data storing means for storing sequence data indicative of the sequence in which the image data are read by said image data reading means;

controlling means for controlling said image data reading means so as to read the image data in accordance with the sequence indicated by the sequence data stored in said sequence data storing means; and displaying means for displaying an image represented by the image data read by said image data reading means: and an automatic performance apparatus comprising:

musical data storing means for storing musical data representing music;

automatic performance means for performing the music automatically by reading the musical data from said musical data storing means;

image data storing means for storing a plurality of image data each of which represents a plurality of images;

timing data storing means for storing timing data indicative of the timing synchronous with advancement of the music and indicative of the timing of switching the respective ones of the plurality of images;

first reading means for reading the timing data stored in said timing data storing means;

second reading means for reading the image data from said image data storing means on the basis of the timing data read by said first reading means;

sequence data storing means for storing sequence data indicative of the sequence in which the image data are read by said second reading means;

controlling means for controlling said second reading means so as to read the image data in accordance with the sequence indicated by the sequence data stored in said sequence data storing means; and displaying means for displaying an image represented by the image data read by said second reading means.

The third object is achieved by an automatic accompaniment apparatus comprising:

a plurality of performance operating members;

accompaniment pattern storing means for storing a plurality of accompaniment patterns;

selecting means for selecting one of the accompaniment patterns stored in said accompaniment pattern storing means;

first reading means for reading the accompaniment pattern selected by said selecting means at predetermined timing;

chord data generating means for generating chord data conforming to the operation of any one of the plurality of performance operating members;

accompaniment sound signal generating means for generating an accompaniment sound signal on the basis of the chord data generated by said chord data generating means and the accompaniment pattern read by said first reading means;

display means;

image data storing means for storing plural kinds of image data to be displayed on said display means;

image advancement data storing means for storing a plurality of image advancement data each representing a sequence of the image data to be displayed on said display means in correspondence to the plurality of accompaniment patterns;

second reading means for reading the image advancement data corresponding to the accompaniment pattern selected by said selecting means from said image advancement data storing means; and means for sequentially reading the image data from said image data storing means on the basis of the image advancement data read by said second reading means and feeding the read data to said display means.

The fourth object is achieved by an automatic accompaniment apparatus comprising:

automatic accompaniment data storing means for storing automatic accompaniment data of a normal pattern and automatic accompaniment data of a special pattern other than the normal pattern;

playing means for playing an automatic accompaniment by sequentially reading the automatic accompaniment data from said automatic accompaniment data storing means;

instructing means for instructing said playing means to play an automatic accompaniment based on the automatic accompaniment data of the special pattern;

image data storing means for storing a plurality of image data each of which represents the corresponding images;

first reading means for sequentially reading the image data from said image data storing means at the timing synchronous with advancement of the automatic accompaniment;

sequence data storing means for storing plural kinds of sequence data indicative of the sequence of the image data read by said first reading means;

second reading means for reading the sequence data of a kind satisfying the instruction given by said instructing means from said sequence data storing means;

controlling means for controlling said first reading means so as to read the image data in accordance with the sequence indicated by the sequence data read by said second reading means; and displaying means for displaying the image which the image data read by said first reading means represents: and an automatic accompaniment apparatus comprising:

automatic accompaniment data storing means for storing automatic accompaniment data of a normal pattern and automatic accompaniment data of a special pattern other than the normal pattern;

playing means for playing an automatic accompaniment by sequentially reading the automatic accompaniment data from said automatic accompaniment data storing means;

instructing means for instructing said playing means to play an automatic accompaniment based on the automatic accompaniment data of the special pattern;

image data storing means for storing a plurality of image data each of which represents the corresponding images;

timing data storing means for storing plural kinds of timing data indicative of the timing of switching the respective images synchronous with advancement of the automatic accompaniment;

first reading means for reading the timing data stored in said timing data storing means;

changing means for changing the kind of the timing data read by said first reading means in accordance with the instruction given by said instructing means;

second reading means for reading the image data from said image data storing means on the basis of the timing data read by said first reading means;

sequence data storing means for storing plural kinds of sequence data indicative of the sequence of the image data read by said second reading means;

third reading means for reading the sequence data of a kind satisfying the instruction given by said instructing means from said sequence storing means;

controlling means for controlling said second reading means so as to read the image data in accordance with the sequence indicated by the sequence data read by said third reading means; and displaying means for displaying the image which the image data read by said second reading means represents.

The above fifth object is achieved by an automatic accompaniment apparatus comprising:

automatic accompaniment data storing means for storing automatic accompaniment data;

chord designating means for sequentially designating a chord for automatic accompaniment;

playing means for playing an automatic accompaniment on the basis of the automatic accompaniment data read from said automatic accompaniment data storing means and the chord designated by said chord designating means;

image data storing means for storing a plurality of image data each of which represent the corresponding images;

image data reading means for reading the image data from said image data storing means at the timing synchronous with the chord advancement formed by the chord designated sequentially by said chords designating means;

sequence data storing means for storing sequence data indicative of the sequence of the image data read by said image data reading means;

controlling means for controlling said image data reading means so as to read the image data in accordance with the sequence indicated by the sequence data stored in said sequence data storing means; and displaying means for displaying the image which the image data read by said image data reading means represents: and an automatic accompaniment apparatus comprising:

automatic accompaniment data storing means for storing automatic accompaniment data;

chord sequence data storing means for storing chord sequence data which represents the sequence of a chord for automatic accompaniment;

chord designating means for sequentially designating the chord for automatic accompaniment on the basis of the chord sequence data read from said chord sequence data storing means;

playing means for playing an automatic accompaniment on the basis of the automatic accompaniment data read from said automatic accompaniment data storing means and the chord designated by said chord designating means;

image data storing means for storing a plurality of image data each of which represent the corresponding images;

timing data storing means for storing timing data indicative of the timing synchronous with the advancement of a chord formed by chord sequentially designated by said chord designating means and indicative of the timing of switching the respective images;

first reading means for reading the timing data from said timing data storing means;

second reading means for reading the image data from said image data storing means on the basis of the timing data read by said first reading means;

sequence data storing means for storing sequence data indicative of the sequence of the image data read by said second reading means;

controlling means for controlling said second reading means so as to read the image data in accordance with the sequence indicated by the sequence data stored in said sequence data storing means; and displaying means for displaying the image which the image data read by said second reading means represents.

BRIEF DESCRIPTION OF THE DRAWINGS

FIG. 27(A) shows the structure of a main pattern picture advancement data of normal mode picture advancement data;

FIG. 27(B) shows the structure of illustrative fill-in picture advancement data of normal mode picture advancement data;

DETAILED DESCRIPTION OF THE PREFERRED EMBODIMENT

An embodiment of the present invention will be described with reference to the drawings.

{STRUCTURE OF THE EMBODIMENT}

Figure 1:
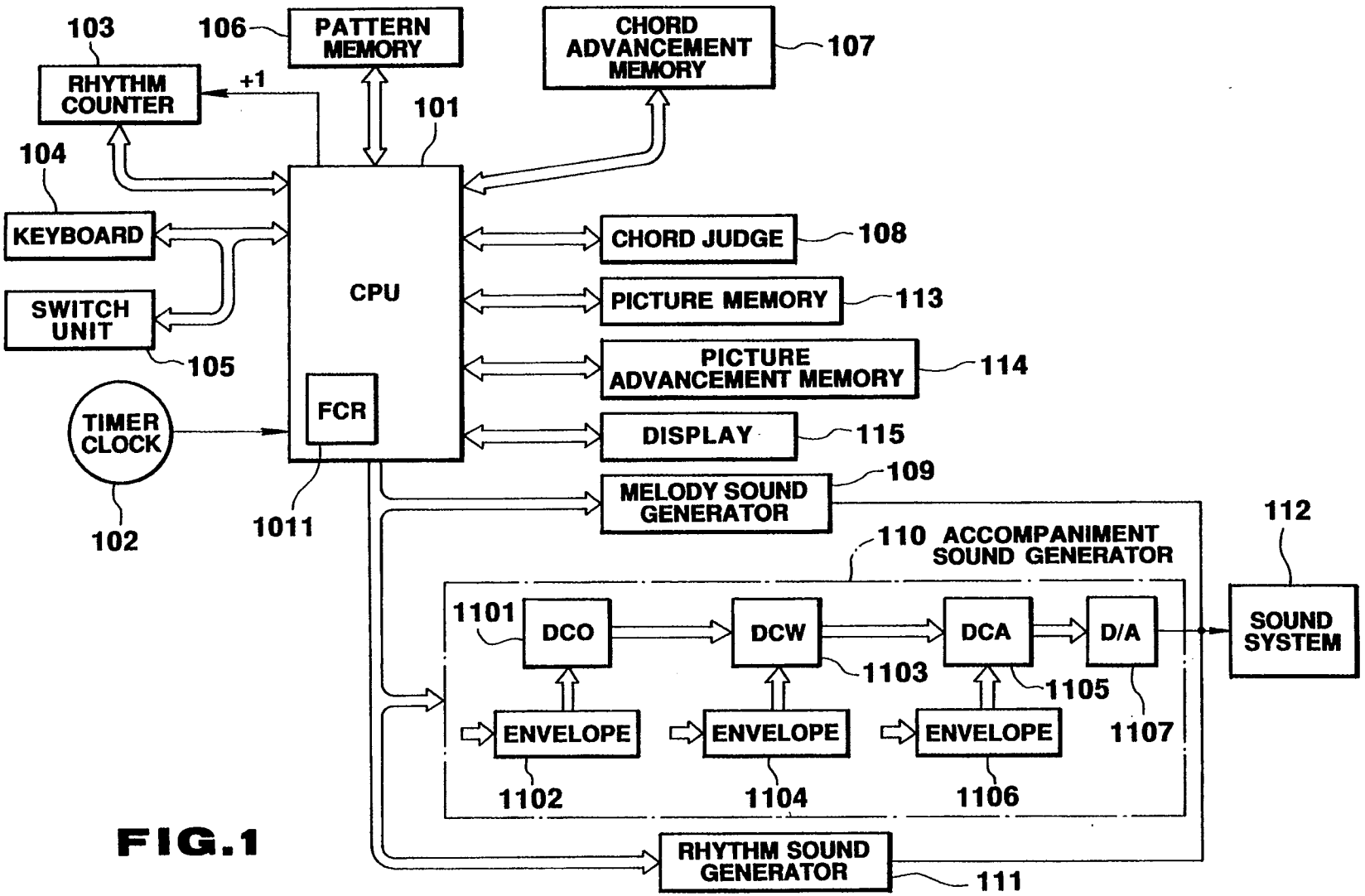
FIG. 1 is a schematic of an embodiment of the present invention.

FIG. 1 is a schematic of an embodiment of the present invention. A central processing unit (CPU) 101 is a controller which controls the entire operation and includes an internal flag counter register (FCR) group 1011.

CPU 101 is connected to keyboard 104, switch unit 105, pattern memory 106, chord advancement memory 107, chord judge unit 108, picture memory 113, picture advancement memory 114, display 115, and timer clock generator 102. CPU 101 is also connected to rhythm counter 103 which counts up by one in accordance with a timer clock from timer clock generator 102. CPU 101 controls melody sound generator 109, accompaniment sound generator 110 and rhythm sound generator 111, and through broadcasts a musical sound system 112.

Melody sound generator 109, accompaniment sound generator 110 and rhythm sound generator 111 each include, for example, as shown by accompaniment sound generator 110, DCO (Digital Controlled Oscillator) 1101 which determines a musical interval and the basic waveform of a generated musical sound, envelope generator 1102 which determines a change in its characteristic of DCO 1101 with time, DCW (Digital Controlled Wave) 1103 which controls the tone quality of the output waveform from DCO 1101, envelope generator 1104 which determines a change in the tone characteristic of DCW 1103 with time, DCA (Digital Controlled Amplifier) 1105 which controls the sound volume for the output waveform of DCW 1103, and envelope generator 1106 which determines a change in the sound volume characteristic of DCA 1105 with time. By changing parameters applied to envelope generators 1102, 1104 and 1106, the generation of various musical sound waveforms is realized. The present invention is not restricted to the above specified structure. For example, rhythm sound generator 111 may have a structure of a PCM sound source type in which the musical sound waveform of an actual rhythm musical instrument is stored in a memory and is read and output synchronously with a rhythm pattern to be described in more detail later.

Sound system 112 amplifies and broadcasts a musical sound waveform output from melody sound generator 109, accompaniment sound generator 110 and rhythm sound generator 111, and includes, for example, an amplifier and a speaker.

Figure 2:
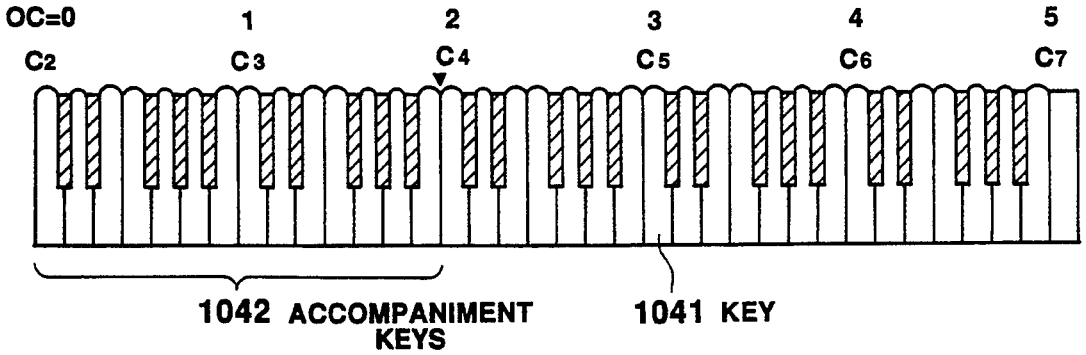
FIG. 2 shows the appearance of a keyboard.

FIG. 2 shows the appearance of keyboard 104 of FIG. 1. As shown in FIG. 2, it includes a plurality of keys 1041 and in the present embodiment, can generate scales for five octaves from $C_2$ indicative of octave "0" (OC=0) to C7 indicative of octave "5" (OC=5). Accompaniment keys 1042 from $C_2$–$C_4$ each function as a usual scale designating key in a normal performance while it functions as a chord designating key in the normal mode of an automatic accompaniment to be described later in more detail.

Figure 3:
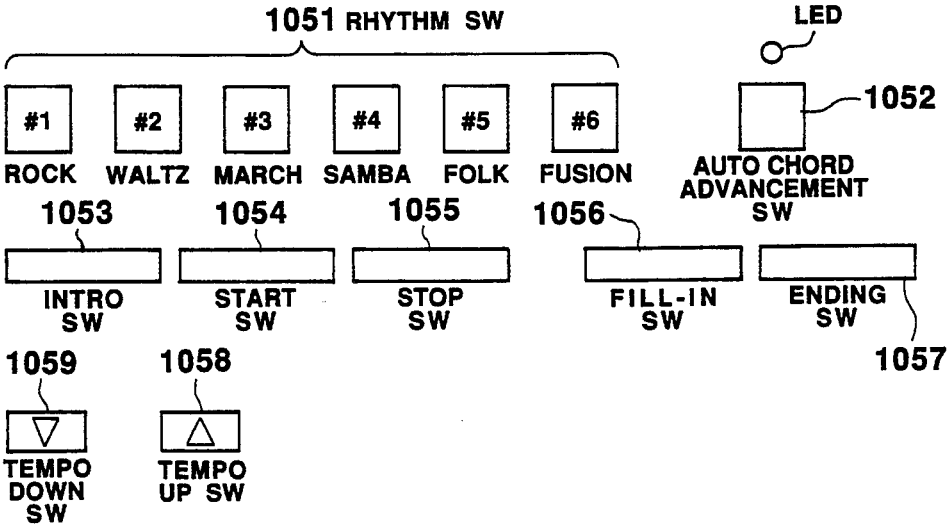
FIG. 3 shows the appearance of a switch unit.

Switch unit 105 of FIG. 1 is disposed adjacent to keyboard 104, as shown in FIG. 3. Switching unit 105 includes switches which perform the corresponding setting operations in the automatic accompaniment.

Rhythm Switch (generally, a switch is hereinafter expressed as SW) 1051 includes 6 switches #1–#6. By depressing any one of the switches, a rhythm in automatic accompaniment is designated. In this case, rhythms such, for example, as rock, waltz, march, samba, folk and fusion are allocated to the rhythm SWs 1051 #1–#6.

Auto chord advancement SW 1052 is a switch which designates an auto chord advancement mode to be described in more detail later. When it is depressed, an LED above the switch in FIG. 3 is lighted.

Start SW 1054 is a switch which instructs the start of automatic accompaniment and image display to be described in more detail later. Stop SW 1055 is a switch which stops the automatic accompaniment and the image display.

Introduction SW 1053, fill-in SW 1056 and ending SW 1057 are switches for starting introduction performance, fill-in performance and ending performance.

Tempo up SW 1058 and tempo down SW 1059 are switches which increase and decrease, respectively, the tempo of automatic accompaniment.

Figure 5:
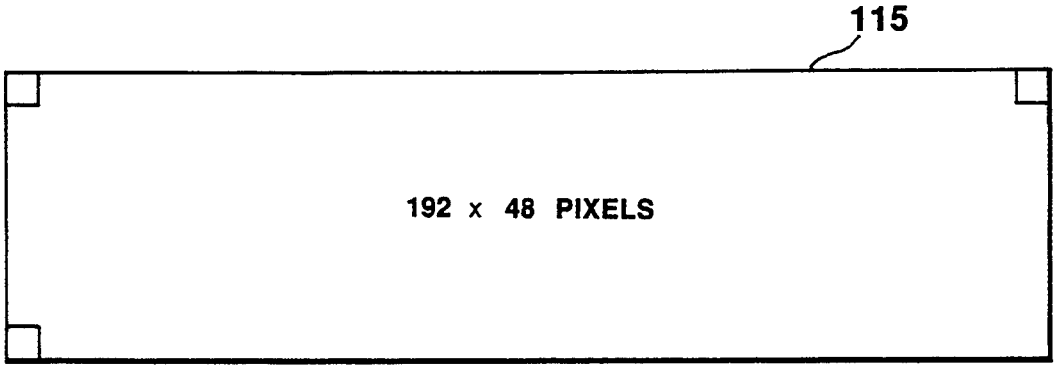
FIG. 5 illustrates a display.

As shown FIG. 5, display 115 includes a rectangular LCD of 9216 pixels which are 192 pixels (horizontal)×48 pixels (vertical).

Figure 6:
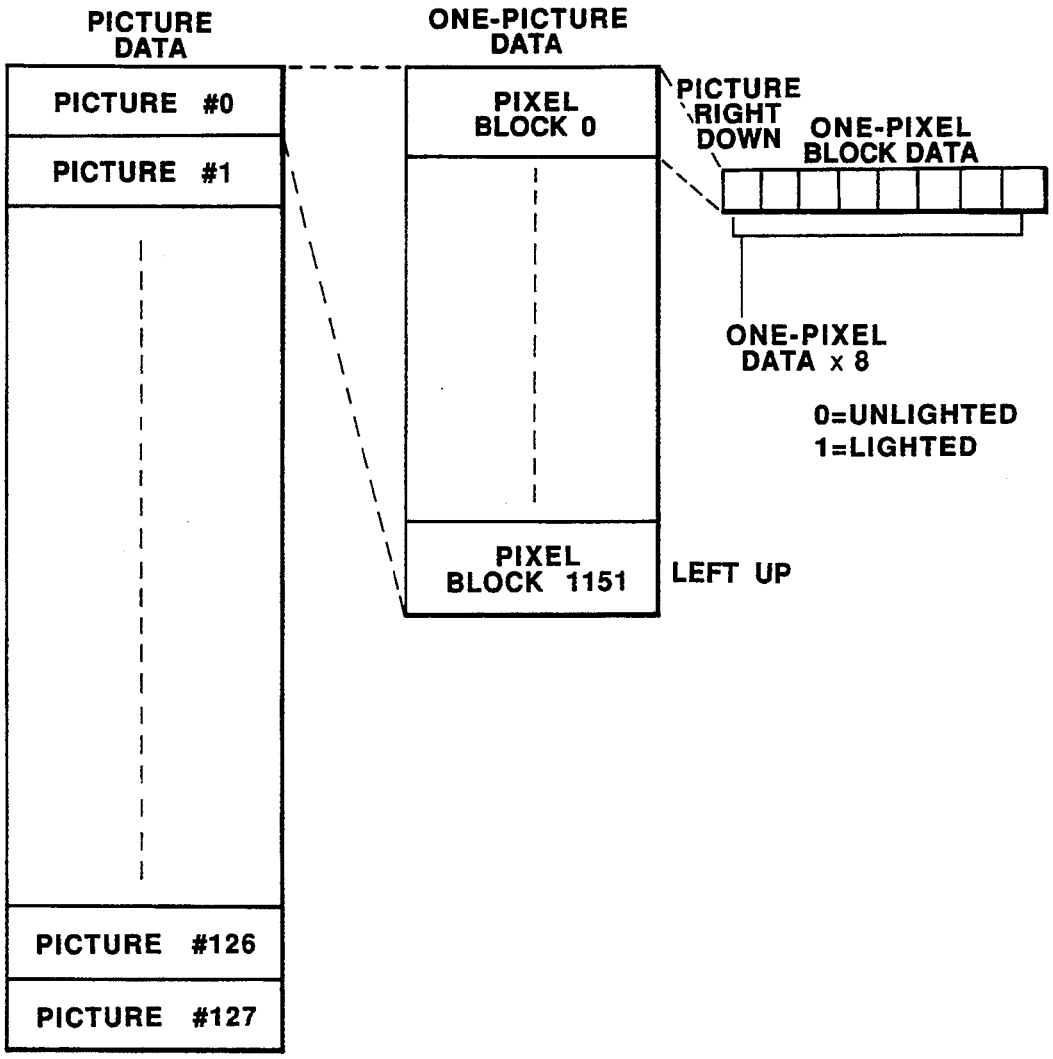
FIG. 6 is a schematic of a picture memory.

As shown in FIG. 6, picture memory 113 stores 122 different picture data entities on pictures #0–#127 which each include 1152 pixel blocks 0–1151, which each include a single horizontal row of 8 pixels, which each are stored as 0 when it is not lighted and as 1 when it is lighted.

Figure 7A:
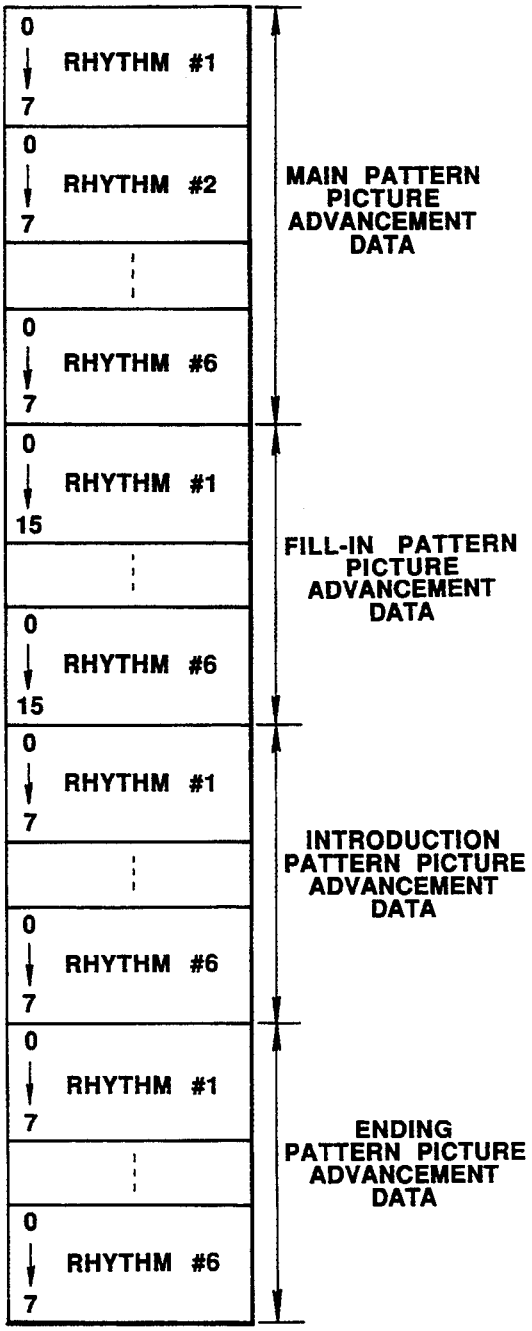
FIG. 7(A) shows the structure of picture advancement data for a normal mode.
Figure 7B:
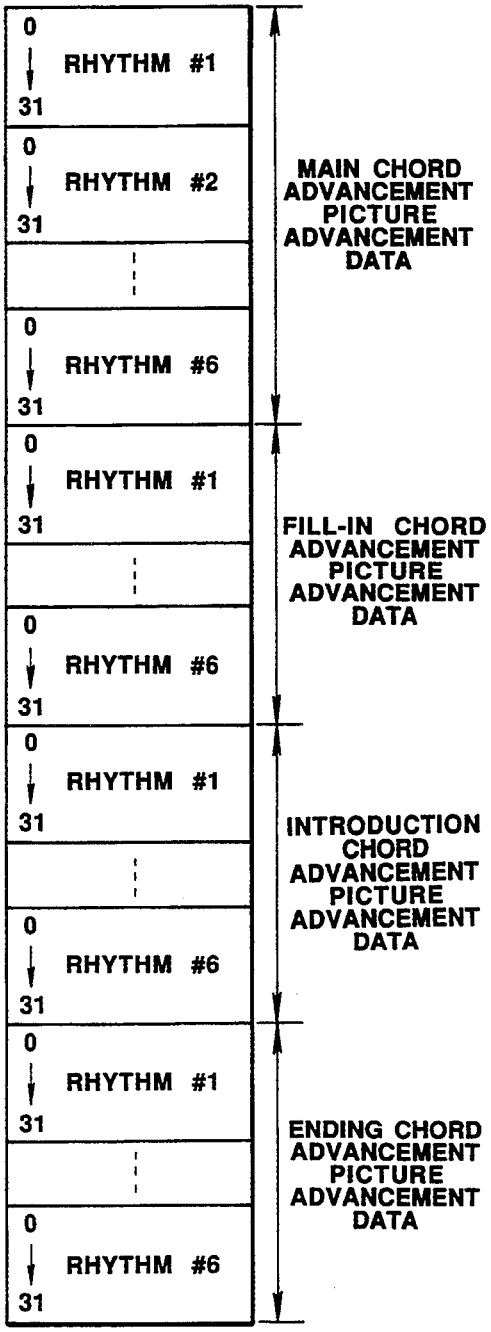
FIG. 7(B) shows the structure of picture advancement data for an auto chord advancement mode.
Figures 7C, 7D, 8:
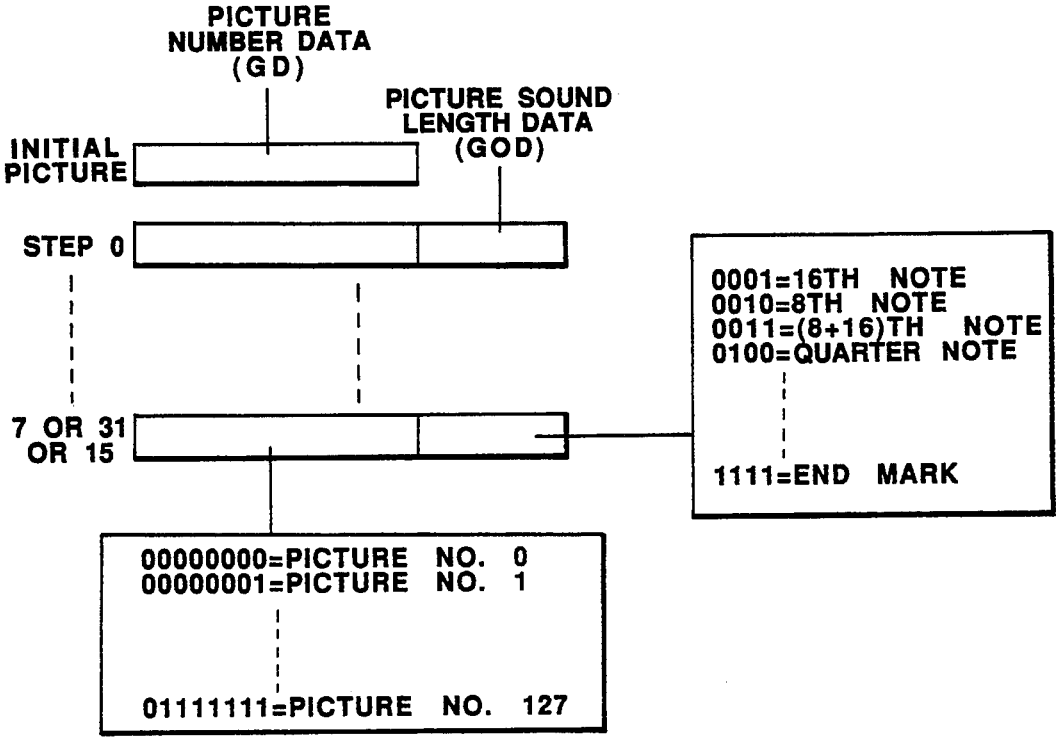
FIG. 7(C) shows the structure of initial picture data for the normal mode.
FIG. 7(D) shows the structure of initial picture data for the auto chord advancement mode.
FIG. 8 shows the structure of part of data in a picture advancement memory.

Picture advancement memory 114 stores normal mode picture advancement data (FIG. 7(A)), auto chord advancement mode picture advancement data (FIG. 7(B)), normal mode initial picture data (FIG. 7(C)), and auto chord advancement mode initial picture data (FIG. 7(D)).

The normal mode picture advancement data includes main pattern picture advancement data, fill-in pattern picture advancement data, introduction pattern picture advancement data and ending pattern picture advancement data, each including data items #1–#6 corresponding to the rhythms #1–#6 for rhythm SWs 1051. Each advancement data entity is stored in steps 0–7 or 0–15.

Similarly, the auto chord advancement mode picture advancement data includes main pattern picture advancement data, fill-in pattern picture advancement data, introduction pattern picture advancement data and ending pattern picture advancement data each of data entities #1–#6 corresponding to rhythms #1–#6 for rhythm SWs 1051. Advancement data entity is stored in steps 0–31.

As the normal mode initial picture data and the auto chord advancement mode initial picture data, single picture data of picture data items #0–#127 are stored in correspondence to rhythms #1–#6.

FIG. 8 shows the structure of data in picture advancement memory 114. Picture number data GD indicative of the initial picture is stored in the header, picture data items NO. 0–127 are then stored in 8 bits for that of groups of steps 0–7; 0–15; and 0–31 selected in accordance with the length of the picture advancement data. Picture sound length data GOD is stored in each step as data on the time taken from the time when the picture data of a step ends to the time when the picture data in the next step is read. Sound length data GOD is set with "0001"=a sixteenth note length as a minimum read period and with "0100"=a fourth note period as a maximum read period.

The minimum read period is the same as the minimum note length (sixteenth note length) in an accompaniment pattern to be described later in more detail. The time length of each sound length data GOD is the same as the minimum note length of sound length data indicative of the length of the accompaniment sound in the accompaniment pattern.

Figure 9:
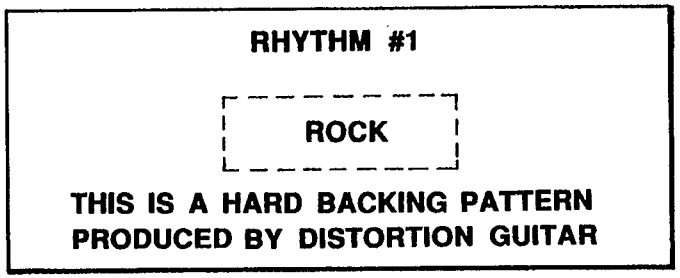
FIG. 9(A) illustrates a picture #1 based on a normal mode initial picture data.
FIG. 9(B) illustrates a picture #2 based on an auto chord advancement mode initial picture data.
FIG. 9(C) illustrates a picture #3 based on an normal mode advancement picture 1.
FIG. 9(D) illustrates a picture #4 based on a normal mode advancement picture 2.
FIG. 9(E) illustrates a picture #5 based on a normal mode advancement picture 3.
FIG. 9(F) illustrates a picture #6 based on an auto chord advancement mode advancement picture 1.
FIG. 9(G) illustrates a picture #7 based on an auto chord advancement mode advancement picture 2.
Figure 9:
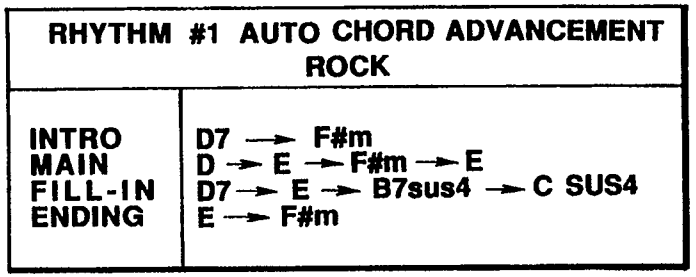
Figure 9:
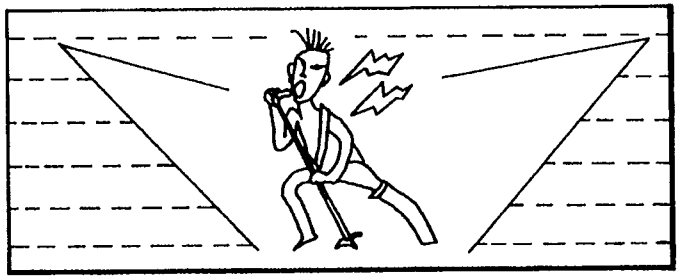
Figure 9:
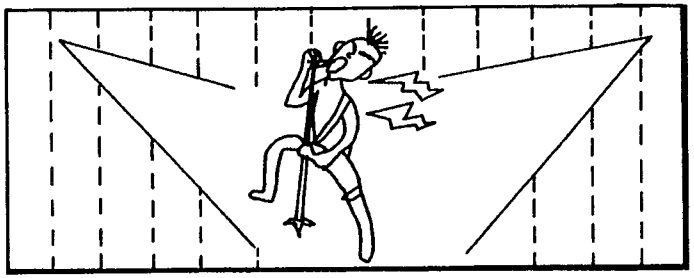
Figure 9:
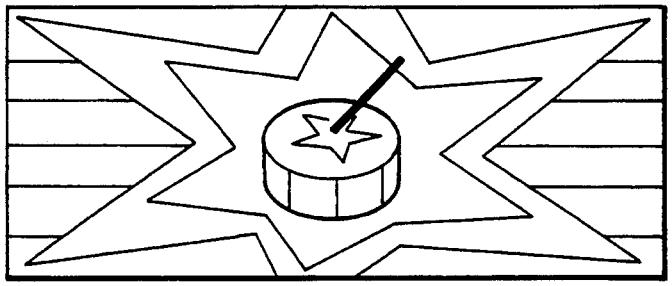
Figure 9:
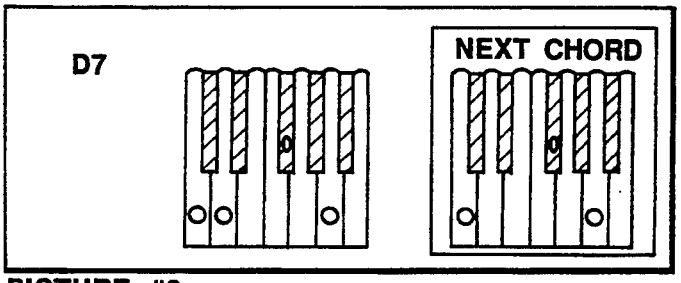
Figure 9:
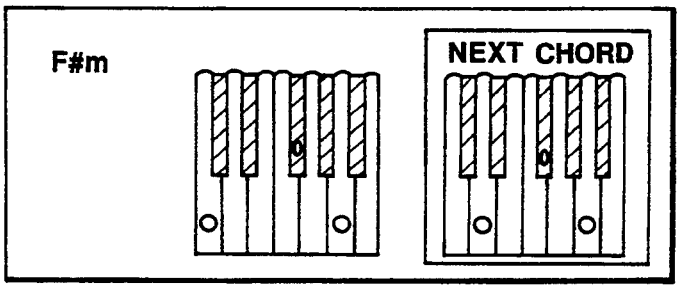

FIGS. 9(A)–(G) each show an illustrative image actually displayed on display 115 on the basis of the data in picture memory 113. Explanation of a rhythm (rhythm #1=rock) is presented in a normal mode initial picture as in picture #1 on the basis of the normal mode initial picture data shown in FIG. 9(A). FIGS. 9(C), (D) and (E) each show one example of changes in the picture occurring when "rock" for rhythm is selected and, in the present embodiment, a figure is displayed. FIG. 9(B) shows one example of a display on the basis of the initial picture data occurring when rhythm #1 "rock" is selected and the auto chord advancement mode is selected, and the chord advancement of each of the introduction, main (pattern), fill-in and ending in the present rhythm is shown.

FIGS. 9(F) and (G) show pictures #6 and #7 displayed as auto chord advancement mode advancement pictures 1 and 2, respectively. They show the chord names of the appropriate measures and positions where the keys concerned are to be depressed, and show the next chords using positions where the keys concerned are to be depressed.

{Outline of the Operation of the Embodiment}

Figure 4:
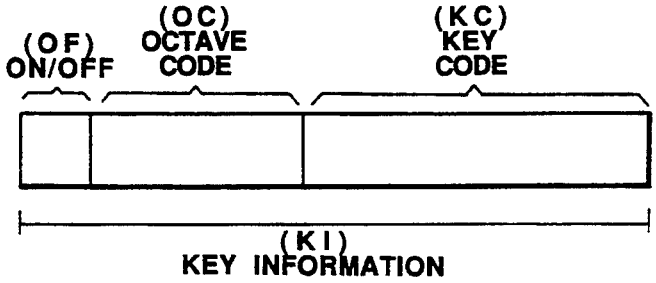
FIG. 4 shows the structure of key data.

First, in a normal performance where no automatic accompaniment is made, key data KI of FIG. 4 is input through keyboard 104 of FIG. 1. Key data KI includes ON/OFF data OF indicative of depressing and releasing a key, and a key code KC indicative of one of 12 scales and an octave code OC indicative of the position of any particular octave. When any key 1041 (FIG. 2) on keyboard 104 is depressed, CPU 101 generates data on the sound height corresponding to the depressed key on the basis of key code KC and octave code OC and delivers it to melody sound generator 109. Thus, melody sound generator 109 generates a melody sound on the basis of the data on sound height and the melody sound is broadcast through sound system 112.

In the automatic accompaniment, two kinds of modes: namely, the normal mode and auto chord advancement mode can be designated.

First, in the normal mode, the performer can select one of six kinds of rhythms; namely, rock, waltz, . . . If he selects one of them, the initial picture corresponding to the selected rhythm is displayed on display 115. Thereafter, when automatic accompaniment is started, rhythm sound generator 111 of FIG. 1 repeatedly generates rhythm accompaniment sounds in rhythm patterns of a plurality of rhythm musical instrument sounds each of 16 separate steps. In this case, the 16 steps correspond, for example, to one measure on a musical score, so that, for example, the same rhythm pattern is iterated in each measure.

Synchronously with the start of the automatic accompaniment, the initial picture disappears and pictures illustrated in FIGS. 9(C), (D) and (E) are displayed on display 115 on the basis of the picture advancement data corresponding to the selected rhythm.

If under such condition the performer depresses any accompaniment key 1042 between $C_2$ and $C_4$ of keyboard 104 of FIG. 1 or 2, accompaniment sound generator 110 of FIG. 1 repeatedly generates accompaniment sound on the basis of predetermined bass sound in a root corresponding to the accompaniment key and in a bass pattern of 16 steps and different from the above-mentioned rhythm pattern. Simultaneously, accompaniment sound generator 110 of FIG. 1 repeatedly generates accompaniment sounds of 3 or 4 predetermined chords in a chord pattern of 16 steps different from the rhythm pattern and bass pattern.

As just described above, if in the normal mode, for example, a rhythm of rock is selected, a rhythm is accompanied in a rhythm pattern of rock of a plurality of rhythm musical instrument sounds, and an animation corresponding to the rock is displayed on display 115. Further, simultaneously with the designation of a chord by accompaniment key 1042 of FIG. 2, the performer can start automatic accompaniment of a bass in a bass pattern/bass tone of rock and a chord in chord pattern/-chord tone of rock is started on the basis of the chord kind and root. At this time, the performer can freely play a melody to the accompaniment by depressing a key 1041 having a higher scale than $C_4$ of keyboard 104 of FIG. 2.

If in the auto chord advancement mode automatic accompaniment is started by selecting a rhythm as in the normal mode, accompaniment of a rhythm is started as in the normal mode and a picture corresponding to the selected rhythm is repeatedly displayed on display 115. Simultaneously, reading the bass pattern and chord pattern different from the rhythm pattern are started. In this case, the bass pattern and chord pattern each are iterated as a pattern of predetermined 16 steps corresponding to the selected rhythm. At this time, the scales of the bass sound and chord sound are automatically designated as chord advancement data entities each comprising a combination of chords stored beforehand and corresponding to the selected rhythm sequentially read, so that the performer is not required to input chords using keyboard 104.

As just described above, if in the auto chord advancement mode, a rock rhythm, for example, is selected, automatic accompaniment is achieved by rhythm accompaniment in a rock rhythm pattern of a plurality of rhythm musical instrumental sounds, bass accompaniment in a rock bass pattern bass advancement, and chord accompaniment in a rock chord pattern chord advancement. The performer can play a melody freely to the accompaniment by depressing any key 1041 of keyboard 104 of FIG. 2.

In any of the normal mode and auto chord advancement mode, the performer can add various performance effects with introduction SW 1053, fill-in SW 1056 and ending SW 1057 of FIG. 3 and also switch rhythm SW 1051 of FIG. 3 even during performance. When introduction SW 1053, fill-in SW 1056 and ending SW 1057 are operated, images displayed on display 115 change in accordance with the respective introduction, fill-in and ending patterns.

{Details of the Normal Mode Operation}

The details of the normal mode operation in the automatic accompaniment will be described below.

Description of FCR

First, the elements of flag counter register group FCR 1011 of FIG. 1 will be shown in FIG. 21 and recited below:

Rhythm number register RR (FIG. 21(*a*)) which is a 3-bit register indicative of a rhythm designated at present by the corresponding one of rhythm SWs 1051 (#1–#6) of FIG. 3);

Pattern register PR (FIG. 21(*b*)) which is a 2-bit register indicative of which of the main pattern, fill-in pattern, introduction pattern and ending pattern the current rhythm pattern or chord pattern is;

Pre-rhythm number register PRR (FIG. 21(*c*)) which is a 3-bit register indicative of the number of the rhythm preceding the current designated rhythm by one rhythm;

Advancement register SR (FIG. 21(*d*));

In-accompaniment flag BF (FIG. 21(*e*)) which is a 1-bit flag indicative of which of the automatic accompaniment and the auto rhythm is involved at present;

Tempo data register TR (FIG. 21(*f*)) which is a 5-bit register indicative of the current tempo, on the basis of which the count RC of rhythm counter 103 counts up;

Auto chord advancement flag ACF (FIG. 21(*g*)) which is a 1-bit flag indicative of whether the auto chord advancement mode is involved;

Pattern change standby flag PTF (FIG, 21(*h*)) which is a 1-bit flag indicative of whether the apparatus is on standby from the time when the rhythm is switched or ending SW 1057 (FIG. 3) is depressed to the time when the pattern is actually switched;

Sound length counter OC (FIG, 21(*i*)) which is a counter which counts by subtracting the sound length in a chord advancement;

Chord counter CC (FIG, 21(*j*)) which is a counter counting up the address of the chord advancement data;

Chord name register CCR (FIG, 21(*k*)) which is a register which stores chord name data CD;

Scale chord register OTCR (FIG. 21(*l*);

Screen sound length counter GOC (FIG. 21(*m*)) which is a counter which measures the sound length of the picture advancement by subtraction;

Screen counter GC (FIG, 21(*n*)) which is a counter which counts up the address of the picture advancement data;

Screen number register GNR (FIG. 21(*o*)) which is a 4-bit register indicative of the current picture # in the picture advancement data.

The normal mode operation will be described below.

Standby Operation

Figure 10:
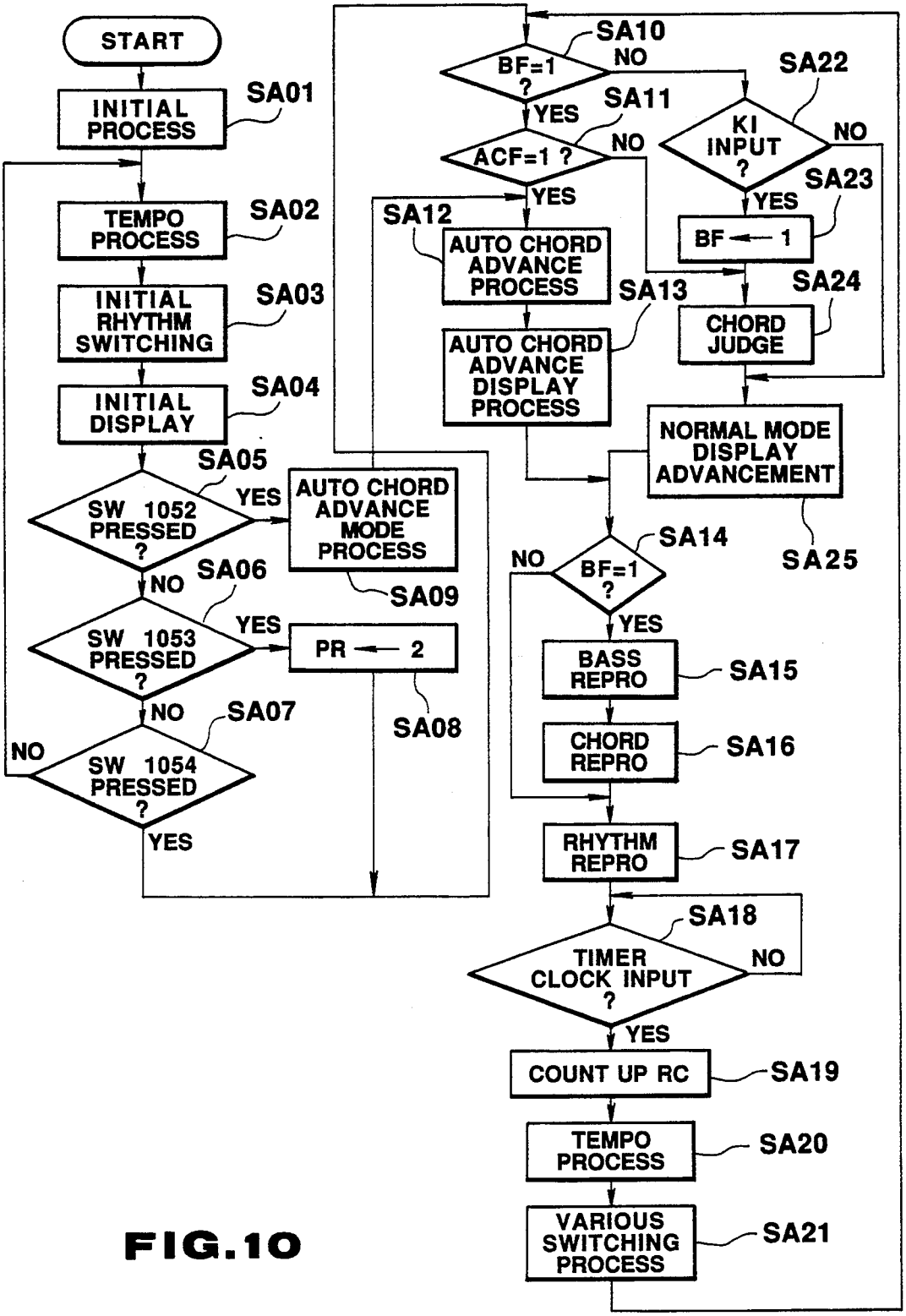
FIG. 10 is a main flowchart for the present embodiment.
Figure 11:
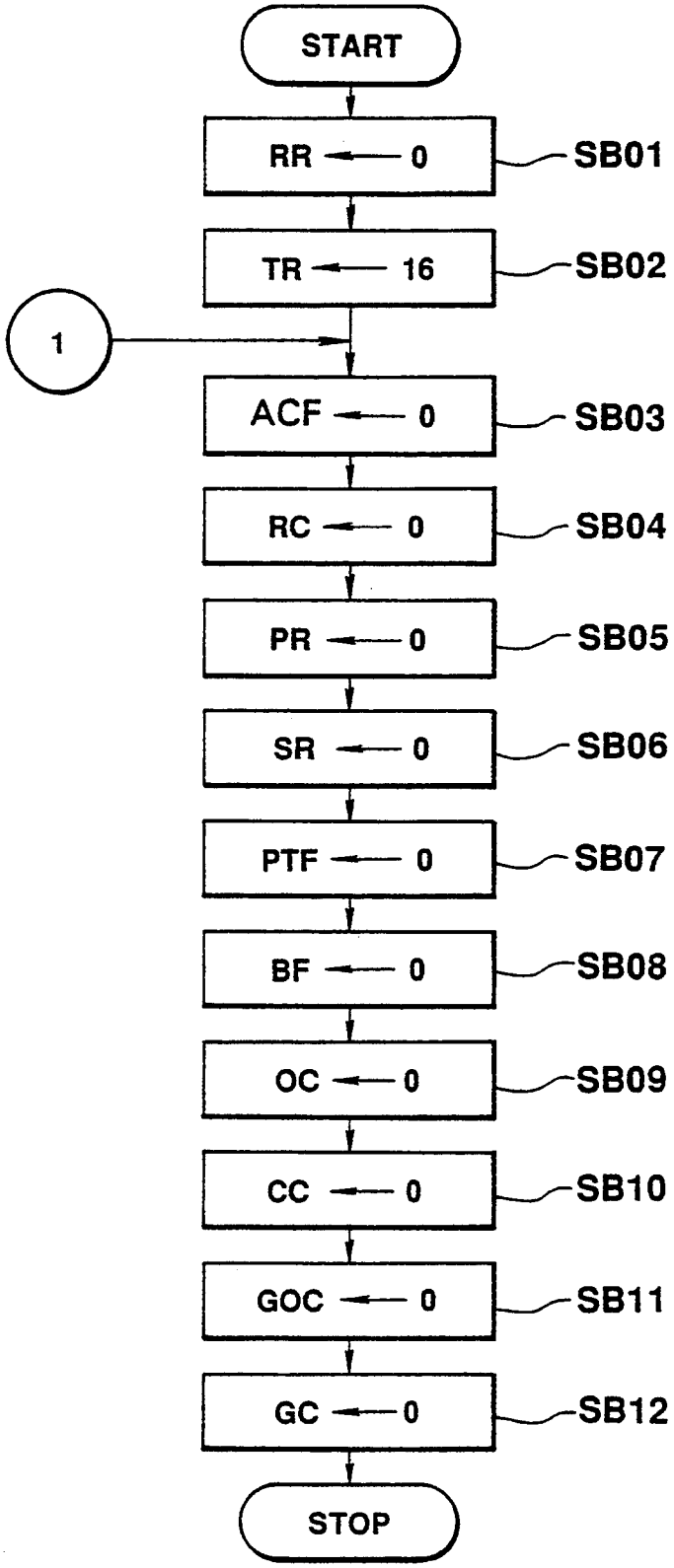
FIG. 11 is a flowchart indicative of the initial processing of the embodiments.

First, the performer turns on a power supply for the apparatus (not shown) to start the program shown by the main operation flowchart of FIG. 10. Initially, initialization is made at SA01. The details of this processing are shown in FIG. 11. At SB01–SB12 various flags and counters are initialized. The reason why the contents of tempo data register TR are initially set to 16 is to set the tempo in the center of the values 0–31 which the register can take, as described in more detail later. After these operations, the initialization is terminated.

After initialization at SA01 in FIG. 10, a processing loop of SA02–SA07 is iterated.

Figure 12:
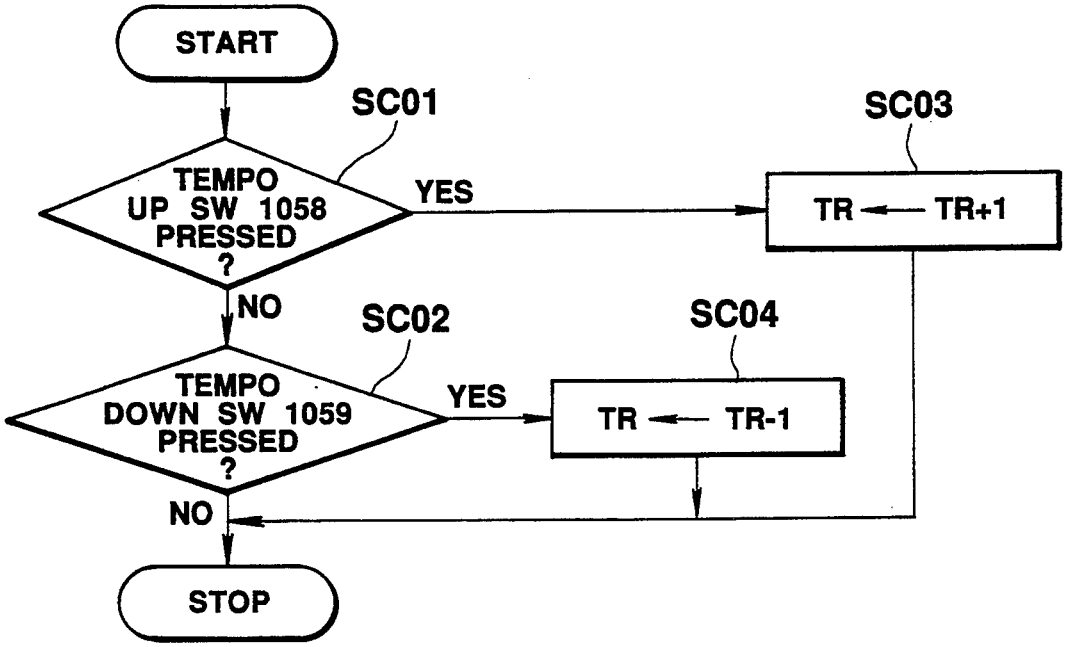
FIG. 12 is a flowchart indicative of the tempo processing of the embodiment.

First, at SA02 a tempo process is performed the details of which are shown in FIG. 12. At step SC01 it is determined whether tempo up sw 1058 is depressed. If so, the value of tempo data register TR is incremented by one at step SC03 to increase the tempo to thereby terminate the tempo process. If the determination is NO at SC01, it is determined whether tempo down SW 1059 of FIG. 3 is depressed at step SC02. If so, the value of tempo data register TR is decremented by one at SC01 to decrease the tempo and terminate the tempo process. The value of the tempo register is controlled such that it does not decrease beyond 0 or does not increase beyond 31 (although not shown). If the determination is NO at SC02, the tempo process is terminated without providing tempo control.

Figure 13:
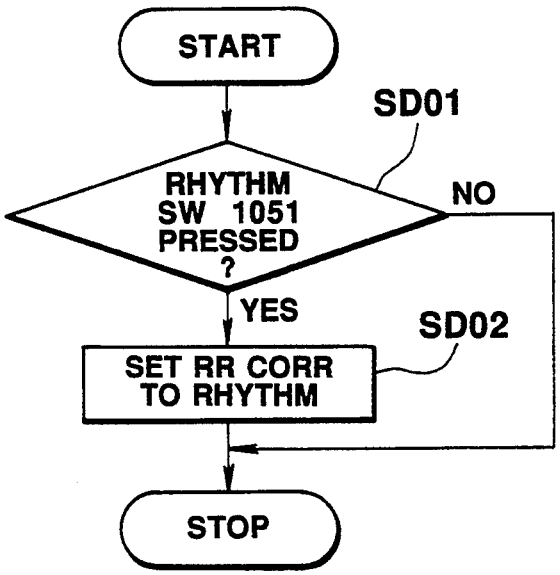
FIG. 13 is a flowchart indicative of an initial rhythm switching operation of the embodiment.

After the tempo process at SA02 in FIG. 10 is completed, the initial rhythm switching operation is performed at SA03, the details of which are shown in FIG. 13. At SD01 it is determined whether rhythm SW 1051 of FIG. 3 is switched. If YES, control passes from SD01 to SD02 to set a value corresponding to the rhythm number of rhythm SW 1051 in rhythm number register RR to switch the rhythm to thereby terminate the initial rhythm switching operation. In this case, as shown in FIG. 21(*a*), the value is one of 0–5 corresponding to rhythm numbers #1–#6 (also see FIG. 3) and set in a binary number of three bits. If rhythm SW 1051 is not switched and the determination at SD01 is NO, the initial rhythm switching operation is terminated without doing anything.

Figure 18:
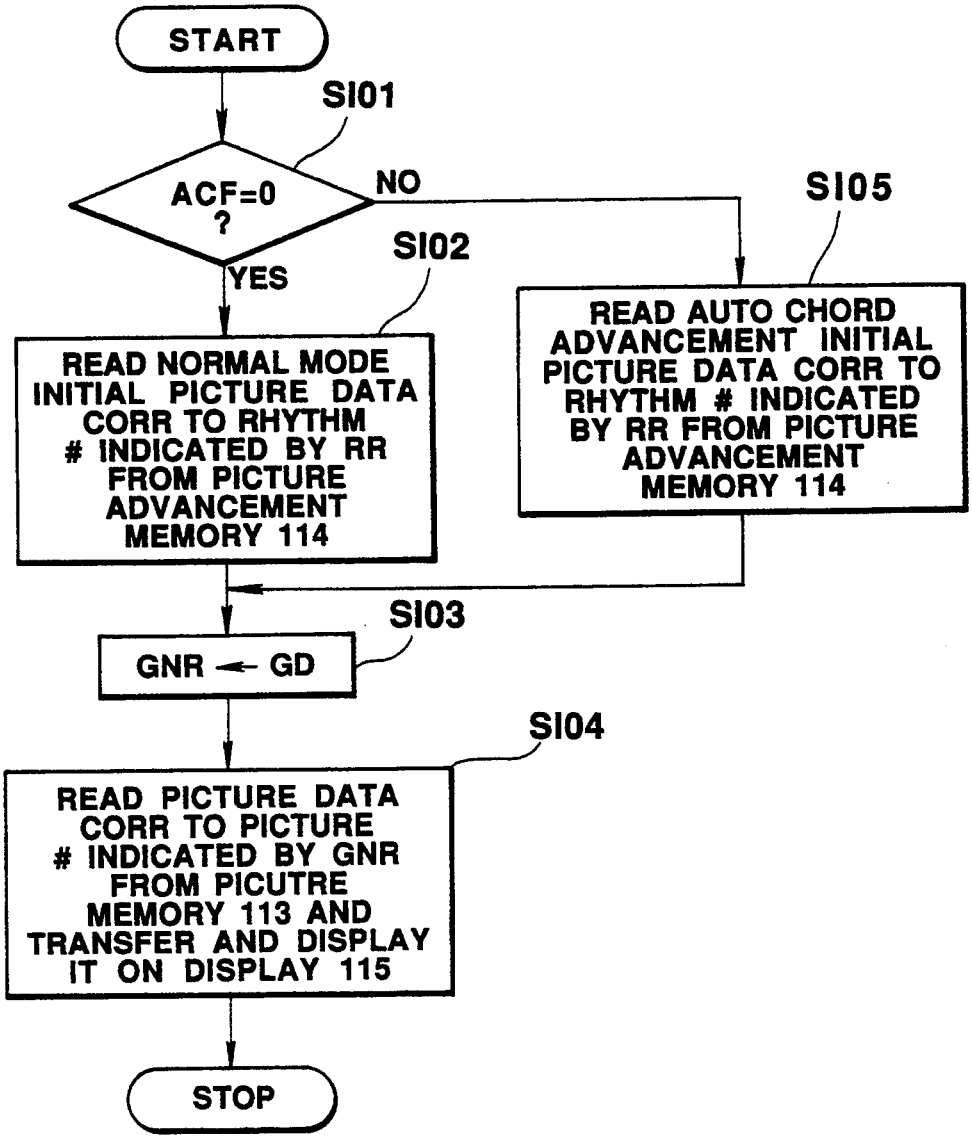
FIG. 18 is a flowchart indicative of the initial display operation of the embodiment.

After the initial rhythm switching at SA03 of FIG. 10 is terminated, initial display is performed at SA04, the details of which are shown in FIG. 18. First, it is determined whether ACF=0. If the normal mode is involved, this determination is YES as shown in FIG. 21(*g*). Therefore, at SI02 data on a rhythm # of the normal mode initial picture data in picture memory 113 and indicated by rhythm number register RR is read.

For example, if rock with rhythm # has been selected, "0" (0=rhythm #1) is stored in rhythm number register RR (FIG. 21(*a*)) and the normal mode initial picture indicated by the "0" is read. Next, at SI03 picture number data GD is stored in picture number register GNR (FIG. 21(*o*)). At SI04 data in picture # in picture memory 113 and indicated by the picture number register GNR is read and the resulting data is transferred to display 115. Therefore, if the processing at SI04 is performed, the initial picture comprising a particular picture illustrated in FIG. 9(A) is displayed on display 115.

Therefore, since such an initial picture displays data on the accompaniment pattern (rock) started from now during the operation standby, the user of the electronic instrument can have data effective for performance using a time during standby.

If the determination is NO at SI01, the auto chord advancement mode is involved, as shown in FIG. 21(*g*), in which case data on the rhythm # of the auto chord advancement initial picture data in picture advancement memory 114 and indicated by RR is read at SI05 and similarly, control passes through SI03 to SI04. Therefore, in this case, the auto chord initial picture illustrated in FIG. 9(B) is displayed.

After the initial display switching operation at SA04 of FIG. 10, it is determined at SA05 whether auto chord advancement SW 1052 of FIG. 3 is depressed or not. Since the SW 1052 is not depressed now in the normal mode, the determination is NO.

Subsequently, it is determined at SA06 whether the introduction SW 1053 of FIG. 3 is depressed or not. The process performed if the SW 1053 is depressed will be described in more detail later.

If the determination is NO at SA06, it is determined at SA07 whether start SW 1054 of FIG. 3 is depressed.

If start SW 1054 is not depressed, the processes at SA02–SA07 are iterated until any one of auto chord advancement SW 1052, introduction SW 1053 and start SW 1054 of FIG. 3 is depressed. Therefore, the initial picture continues to be displayed for this interval of time.

Reproduction of Only Rhythm Sound

When the performer depresses start SW 1054 of FIG. 3 in the standby state at SA02–SA06 of FIG. 10, reproduction of only the rhythm sound starts.

First, after the determination is YES at SA07, it is determined at SA10 whether the contents of accompaniment flag BF are 1 or not, or whether the automatic accompaniment is being made or the auto rhythm is being generated. Since the accompaniment flag is initially set to 0 (SB08 of FIG. 11) now in the initial process at SA01, the auto rhythm is involved at the beginning, so that the determination at SA10 becomes NO.

Figure 19:
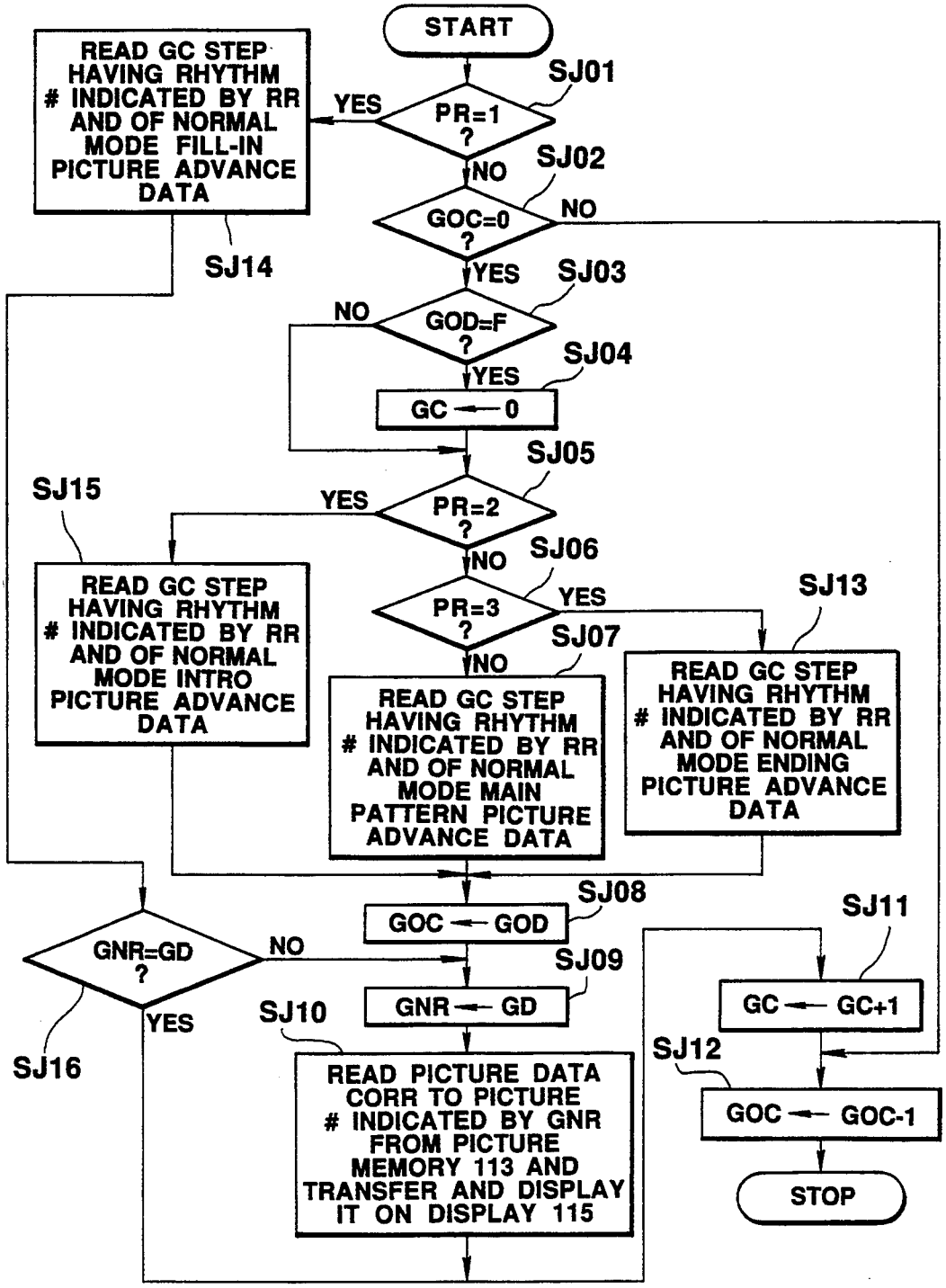
FIG. 19 is a flowchart indicative of the display advancement operation of the embodiment for the normal mode.

Subsequently, unless the performer depresses accompaniment key 1042 of FIG. 2, the determination at SA22 also becomes NO, and the normal mode display advancement process is made at SA25. The details of the normal mode display advancement process are shown in FIG. 19. First, it is determined at SJ01 whether the value of pattern register PR is "1" or not, namely, whether fill-in SW 1056 is depressed or not. If the determination is NO, control passes to SJ02 where it is determined whether the value of picture sound length counter GOC is "0" or not. If the determination is YES, it means the timing of reading the next picture data. It is further determined at SJ03 whether picture sound length data GOD=F. Screen sound length data GOD becomes "F" when one display pattern ends as shown in FIG. 27(A). If the determination is YES at SJ03, picture counter GC is set to "0" at SJ04. Therefore, by execution of SJ03 and SJ04, the image display on the basis of the picture advancement data and executed at present is repeatedly read and displayed each time it is terminated. At this time, the accompaniment pattern is similarly iterated, that is, both the image display and accompaniment pattern are iterated. Therefore, the accompaniment pattern is visually related to the picture display for learning purposes.

If the determination is NO at SJ03, it is determined at SJ05 whether PR=2 or not, namely, whether introduction SW 1053 is depressed or not. If the determination is NO, it is further determined at SJ06 whether PR=3 or not, namely, whether ending SW 1057 is depressed or not. If this determination is also NO, the GC step of rhythm # indicated by RR and of the normal mode main pattern picture advancement data is read (SJ07). If the illustration of FIG. 27(A) is the main pattern picture advancement of rhythm #1 and the step at the current point in time is "3", GD=#4 and GOD=1 are read.

GOD=1 is stored in GOC (SJ08) and GD=#4 is stored in GNR (SJ09). The picture # (FIG. 6) indicated by GNR and in picture memory 113 is read and transferred to and displayed by display 115 (SJ10). GC is then incremented (SJ11) and GCO is decremented (SJ12).

As will be seen from SJ07 and SJ10 processes and FIGS. 6 and 8, picture memory 113 only stores picture data items #0–#127 while picture advancement memory 114 only stores in each accompaniment pattern data on picture advancement comprising a combination of picture data items #0–#127.

Therefore, even if a plurality of accompaniment patterns is set, picture memory 113 is only required to have a capacity enough to store only picture data items used for an accompaniment pattern in spite of the number of kinds of accompaniment patterns used. Screen advancement memory 114 is only required to have a capacity enough to store only the sequence of picture data items and sound length data in spite of the contents of the picture data. Therefore, the use of memories 113, 114 of a small capacity permits display 115 to make a display corresponding to the accompaniment pattern to thereby provide a visual feeling of play.

The processing performed when the determinations at SJ01, SJ05 and SJ06 are YES will be described later.

Figure 14:
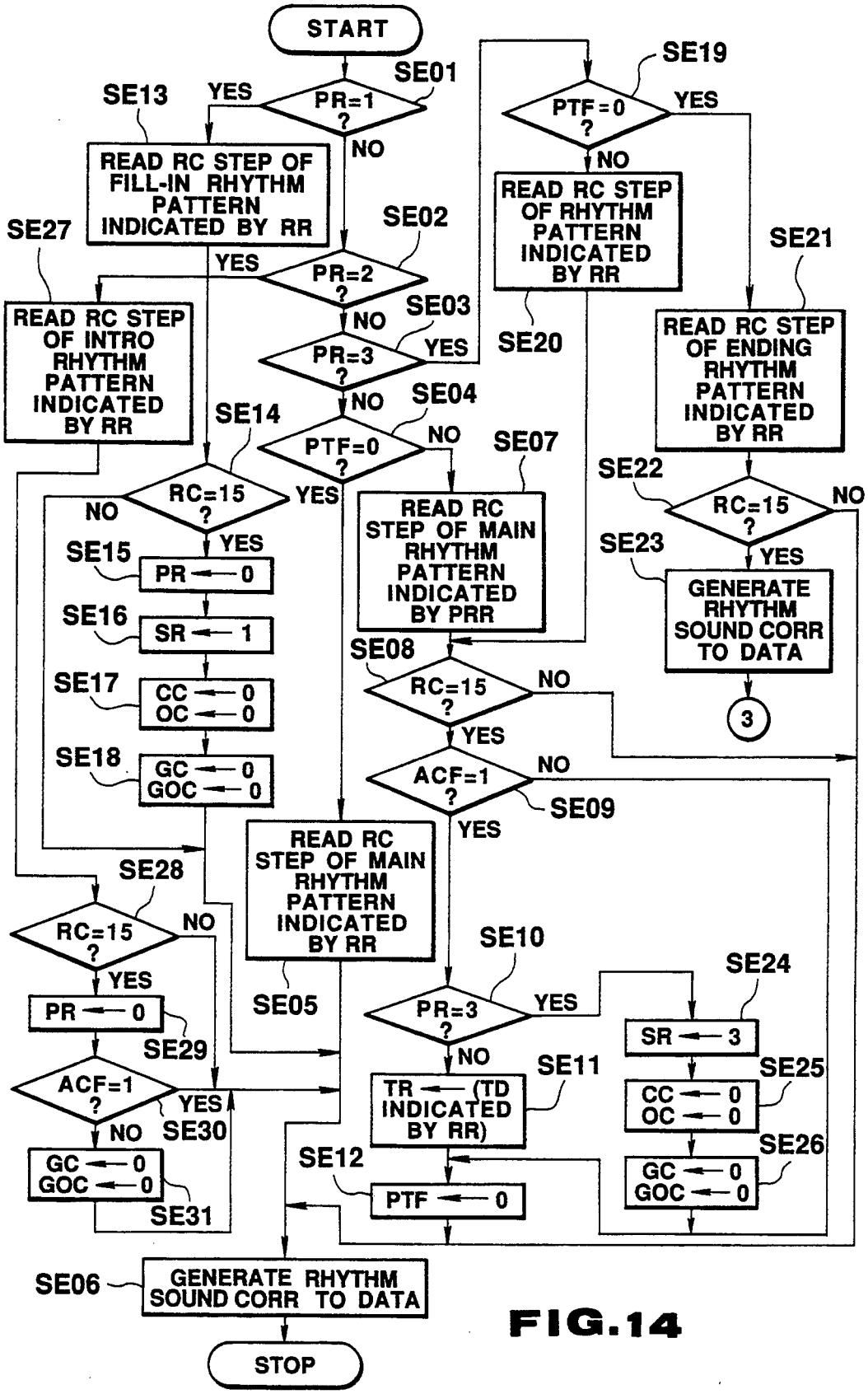
FIG. 14 is a flowchart indicative of a rhythm production of the embodiment.

After the normal mode display advancement process is performed at SA25 as mentioned above, it is determined at SA14 of FIG. 10 that BF=1, but this determination becomes NO at present, as mentioned above. Therefore, the rhythm reproduction is performed at SA17, the details of which are shown in FIG. 14.

It is first determined at SE01, SE02 and SE03 whether the value of pattern register PR is 1, 2 and 3, respectively; namely, it is determined whether the pattern to be automatically accompanied is a fill-in pattern, introduction pattern or ending pattern. Since pattern register PR is initially set to 0 in the initial process at SA01 when the performer has depressed start SW 1054 (SB05 in FIG. 11), initially the main pattern appears and determinations at SE01–SE03 are all NO and control passes to the processing at SE04.

At SE04 it is determined whether the value of pattern change standby flag PTF is 0 or not. The function of this flag will be described later. Initially, since the flag has been initially set to 0 in the initial process at SA01 (SB07 in FIG. 11), the determination at SE04 becomes NO and control passes to the processing at SE05.

Figure 22:
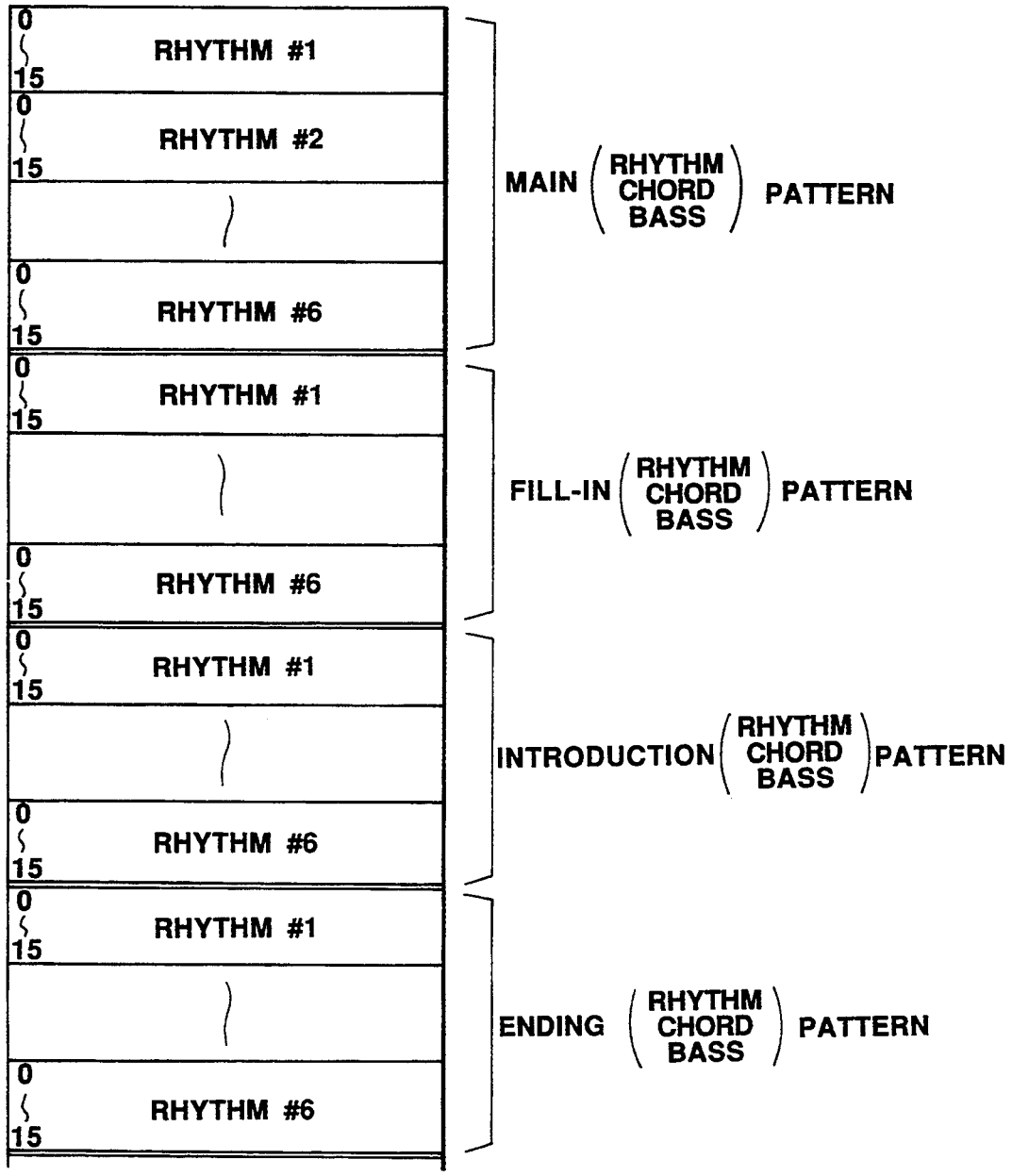
FIG. 22 is a schematic of a pattern memory.

At SE05 that of 16 steps of the main rhythm pattern corresponding to a rhythm number indicated by rhythm number register RR and indicative of the count RC of rhythm counter 103 of FIG. 1 is read. Now, a rhythm pattern having a structure shown in FIG. 22 (a chord pattern and a base pattern will be described later) is stored in pattern memory 106 connected to CPU 101. As shown in FIG. 22, the rhythm pattern includes the main pattern, fill-in pattern, introduction pattern and ending pattern. Each of those patterns includes rhythms #1–#6 of 16 steps 0–15.

Figure 23A:
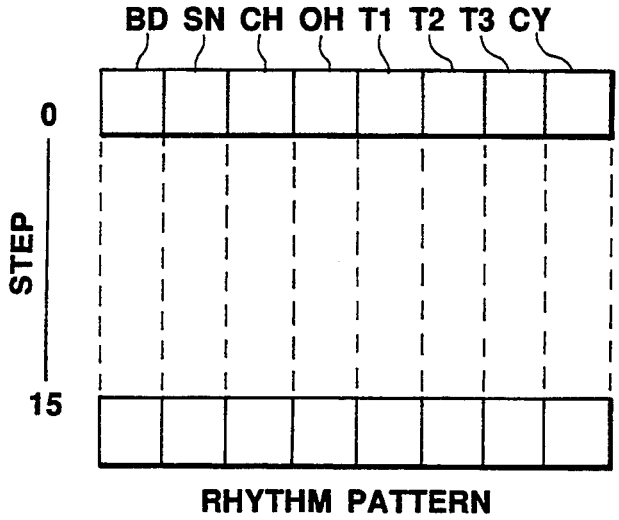
FIGS. 23(*a*)-(*c*) each show the structure of data in each pattern.
Figure 23B:
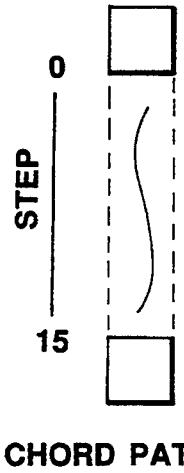

FIG. 23(*a*) shows each of the rhythm patterns of 16 steps of FIG. 22. As shown in FIG. 23(*a*), whether or not a rhythm sound is to be generated at each step in the automatic accompaniment can be instructed for each of the 8 rhythm musical instrument sounds in a binary number of 0 or 1. Reference character BD denotes a bass drum sound; SN, a snare drum sound; CH, a closed hi-hat sound; OH, an open hi-hat sound; T1–T3, tom 1–3 sound; and CY, cymbals. In these structures, at SE05 of FIG. 14 CPU 101 of FIG. 1 reads a step corresponding to the count of rhythm counter 103 of FIG. 1 from that having a rhythm number (one of #1–#6) corresponding to the value indicated by rhythm number register RR and of the main rhythm patterns of FIG. 22 stored in pattern memory 106.

At SE06 of FIG. 14 subsequent to the above operation, CPU gives rhythm sound generator 111 of FIG. 1 a command to generate a rhythm sound related to "1" designated at the read step. At this time, as shown in FIG. 23(*a*), about 8 kinds of rhythm sounds are generated in parallel, so that the above operation for 8 tones is required, but it can be performed separately for each rhythm sound because rhythm sound generator 111 of FIG. 1 is operated in a time division manner. Thus, rhythm sound generator 111 generates a rhythm sound at a timing based on the rhythm pattern for each rhythm sound and which is broadcast through sound system 112.

When the processing at SE06 is terminated, reproduction of a rhythm sound for one step is terminated.

When reproduction of the rhythm for one step is terminated at SA17 of FIG. 10, the operation at SA18 is repeated until a timer clock from timer clock generator 102 of FIG. 1 is received.

When a timer clock is received, rhythm counter 103 of FIG. 1 is incremented at SA19.

After processes at SA20, SA21 are completed (to be described later in more detail) the determination at each of SA10, SA22 becomes NO (which will also be described in more detail later), and the normal mode display advancement process at SA25 and the reproduction at SA17 are again performed. At this time, since the count of rhythm counter 103 of FIG. 1 has been incremented by one, the step read at SJ07 of FIG. 19 from that having a rhythm number (one of #1–#6) corresponding to a value indicated by rhythm number register RR and of the main rhythm patterns of FIG. 27(A) stored in picture advancement memory 114 of FIG. 1 is advanced by one compared to the last processing.

Similarly, since the count of rhythm counter 103 of FIG. 1 has been incremented by one, the step read at SE05 of FIG. 14 from that of the main rhythm patterns of FIG. 22 stored in pattern memory 106 of FIG. 1 and having a rhythm number (one of #1–#6) corresponding to the value indicated by rhythm number register RR advances by one compared to the last processing.

The read step is transferred to and displayed on display 115 at SJ10 of FIG. 19 and a rhythm sound is generated at SE06 of FIG. 14.

As described above, a loop process involving SA10–SA22–SA25–SA14–SA17–SA21–SA10 of FIG. 10 is iterated to sequentially read 8 step (0–7) picture advancement data items having a rhythm # (one of #1–#6) corresponding to the value indicated by rhythm number register RR and of the main pattern picture advancement data of FIG. 7(A) and to display those data items on display 115. Those of the particular rhythm patterns of FIG. 14 and including 16 steps having a rhythm number (one of #1–#6) corresponding to the value indicated by rhythm number register RR are sequentially read and rhythm sounds are generated correspondingly.

In this case, rhythm counter 103 of FIG. 1 is a hexadecimal counter which counts up from step 0 to step 15 (for 16 steps) and then returns to 0 again, so that the respective rhythm sounds for 16 predetermined steps are generated repeatedly. Those 16 steps correspond to, for example, one measure on a musical score. Namely, the respective about 8 different rhythm sounds at automatic accompaniment repeatedly plays a given rhythm pattern for each measure.

Figure 28:
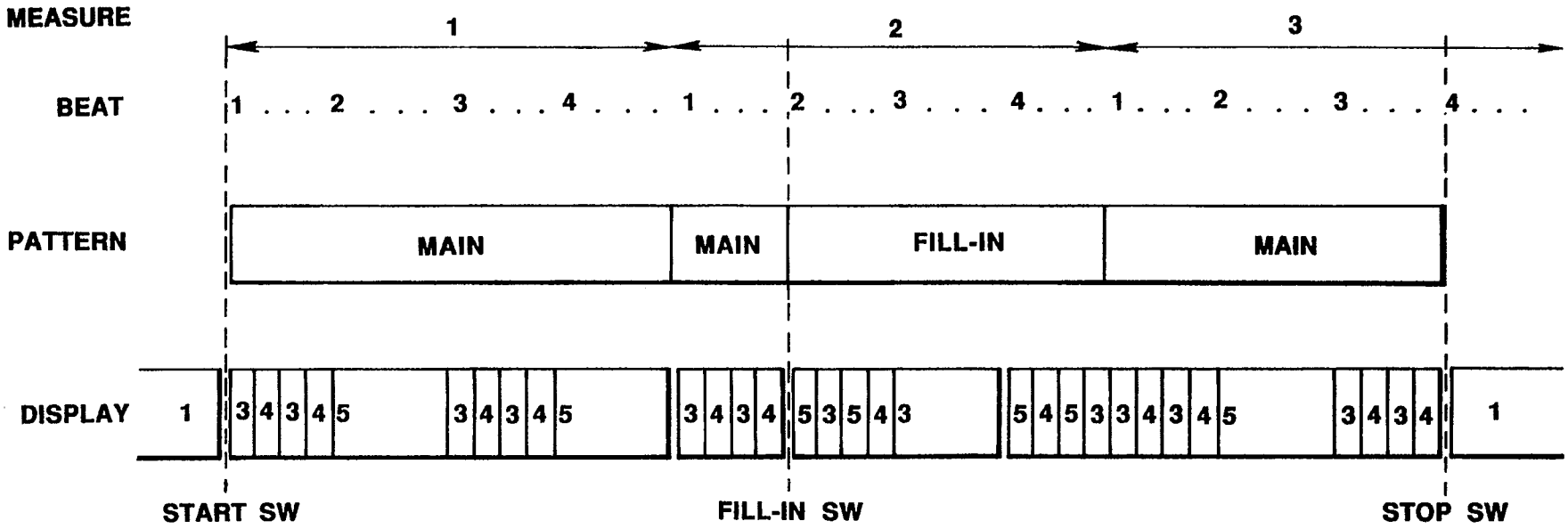
FIG. 28 shows the structure of an illustrative advancing picture in the normal mode.

As shown in FIG. 27(A), the main pattern picture advancement data is constituted by five steps 0–4. Since the fourth-step sound length is "4", 8 steps correspond to the read step of the main rhythm pattern. Therefore, as shown in a first measure of FIG. 28(A), the main rhythm pattern is executed once in one measure while the same display pattern is twice iterated in display 115. Thus, the sound of the main rhythm pattern and the picture on display 115 coincide again at the head of the next of second measure. Therefore, the main rhythm pattern and the starting and ending points of the picture advancement are synchronized and hence an image is displayed at all times synchronously with the automatic accompaniment.

Since the minimum read periods of the main rhythm pattern and picture advancement are less the length of a sixteenth note, both rhythmically, so that the performer is caused to visually recognize the rhythm timing of rhythm in the automatic accompaniment.

While in the present embodiment the picture advancement pattern having a time length which is half of the time length of the main pattern has been illustrated, the performer is further caused to visually recognize the rhythm timing of the automatic accompaniment.

In the main-pattern picture advancement shown in FIG. 27(A), the picture sound length data of step 4 is "4" and the timing of reading the next picture data is delayed compared to the timing of reading the other steps. Therefore, a change in the picture displayed on display 115 is not monotonous and can improve a feeling of visual play.

When the Tempo is Switched during Reproduction of only the Rhythm Sound

In the reproduction of only the rhythm sound, the speed of generating the rhythm sound is determined by the rate at which rhythm counter 103 of FIG. 1 counts up at SA19 of FIG. 10, namely, by the rate at which a timer clock is received from timer clock 102 of FIG. 1 at SA18. The timing of receiving the timer clock is determined by CPU 101 of FIG. 1 by 31 steps in accordance with the corresponding one of values "0"–"31" which tempo data register TR assumes. The value of tempo data register TR is initially set to an intermediate value of 16 in the initial process at SA01 of FIG. 10 (SB02 of FIG. 11) or may be changed before automatic accompaniment at SA02 of FIG. 10.

In addition to this processing, the performer can change the value of tempo data register TR at SA20 by operating tempo up SW 1058 or tempo down SW 1059 of FIG. 3 also during the rhythm sound reproduction. This processing is quite similar to the tempo processing at SA02 and is shown in FIG. 12 already described.

The performer can change the tempo of a rhythm sound generated also during automatic accompaniment by the above processing.

When Rhythm is Switched during Reproduction of only the Rhythm Sound

Which of the main rhythm patterns with rhythm numbers #1–#6 is selected in FIG. 22 in the reproduction of only the rhythm is determined by that of rhythm numbers #1–#6 corresponding to that of the values "0"–"5" indicated by rhythm number register RR.

Figure 15:
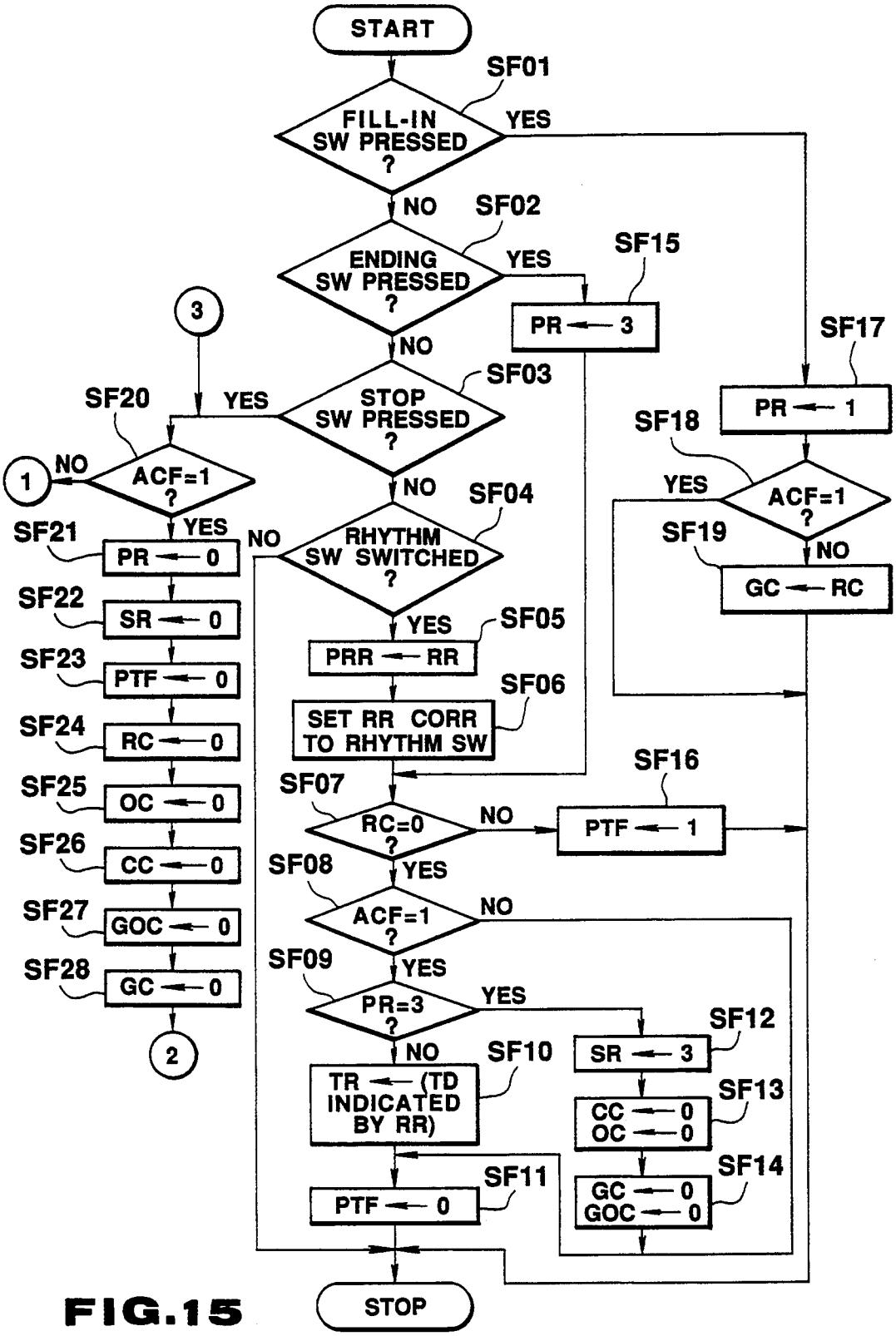
FIG. 15 is a flowchart indicative of various switching operations of the embodiment.

The value of rhythm number register RR is changed at SA03 of FIG. 10 before the start of automatic accompaniment. When the performer selects a desired one of rhythm SWs 1051 of #1–#6 of FIG. 3 also during the reproduction of a rhythm sound, he can change the rhythm pattern arbitrarily. This operation is realized as a part of various switching operations at SA21 of FIG. 10 and the details of the operation are shown in FIG. 15.

First, all the determinations at SF01–SF03 become NO, as will be described later in more detail, and control passes to the processing at SF04 where unless rhythm SW 1051 of FIG. 3 is switched, the determination at SF04 becomes NO and the various switching operations end. If the rhythm SW is switched, the determination at SF04 becomes YES and control passes to the processes at SF05 and SF06.

AT SF05 the value of rhythm number register RR existing so far is copied into prerhythm number register PRR. At SF06 a value corresponding to the rhythm number of rhythm SW 1051 is set in rhythm number register RR to switch the rhythm.

At SF07 it is determined whether the count RC of rhythm counter 103 of FIG. 1 (indicative of a step from which the next sound is to be generated) is 0 or not or whether the timing is the one at which a main rhythm pattern of 16 steps is just appropriate for separation.

If the determination at SF07 is YES, or, if the timing involves appropriate separation, control passes to SF08 where it is determined whether the value of auto chord advancement flag ACF is 1 or not. Since the normal mode is involved at present and the contents of ACF are still maintained at 0 set in the initial processing at SA03 of FIG. 10 (SB03 in FIG. 11), the determination is NO and control passes to SF11 where the value of pattern change standby flag PTF is set to 0 and the various switching operations are terminated. Namely, the value of PTF becomes 0 at the timing appropriate for separating the main rhythm pattern of 16 steps.

If the determination at SF07 is NO, or if a main pattern of 16 steps is halfway, through its performance, control passes to SF16 where the value of pattern change standby flag PTF is set to 1 and various switching operations are terminated.

In this way, after the value of rhythm number register RR is changed and the value of pattern change standby flag PTF is set, the determinations at SA10, SA14, SA22 of FIG. 10 become NO, and normal mode display advancement process at SA25 and rhythm reproduction at SA14 start.

If the rhythm is switched at the timing appropriate for separation of a main rhythm pattern of 16 steps, the value of pattern change standby flag PTF is 0, so that control passes SE0114 SE03 of FIG. 14 and the determination at SE04 becomes YES. Therefore, at SE05 those of the particular patterns of FIG. 22 stored in pattern memory 106 of FIG. 1 and having a rhythm number corresponding to a new value indicated by rhythm number register RR are sequentially read, starting with step 0, due to rhythm switching and the rhythm sound is thereafter generated in the changed rhythm pattern.

At this time, the determinations at SJ01, SJ05, SJ06 are NO in the normal mode display advancement process of FIG. 19. As mentioned above, if the rhythm is switched at a timing appropriate for separating the main rhythm pattern and the value of pattern change standby flag PTF is 0, the determination at SJ02 becomes YES. Therefore, after SJ03–SJ06 of FIG. 19, the GC step having a rhythm # indicated by RR and of the normal mode particular pattern picture advancement data of FIG. 7(A) stored in picture advancement memory 114 of FIG. 1 is read at SJ07. At this time, if, as mentioned above, the main patterns are sequentially read, starting with step 0, picture advancement data is also read, starting with step 0, on the basis of the time lengths of both the data. Thereafter, the changed picture advancement data is displayed.

If the rhythm is switched halfway through reading the main rhythm pattern of 16 steps, the value of pattern change standby flag PTF is 1, so that control passes through SE01–SE03 of FIG. 14 and the determination at SE04 becomes NO and control then passes to SE07.

At SE07 a step corresponding to the count RC of rhythm counter 103 of FIG. 1 is read from that having a rhythm number corresponding to the value indicated by prerhythm number register PRR and of the main rhythm patterns of FIG. 2 stored in pattern memory 106 of FIG. 1. Since prerhythm number register PRR stores a value corresponding to the rhythm number before the rhythm is switched, control passes to SE06 where the rhythm sound is generated in the main rhythm pattern before the rhythm is switched until the count RC of rhythm counter 103 of FIG. 1 is determined as being 15 at SE08.

When the rhythm reproduction at SA17 is iterated through a loop of SA10–SA21 of FIG. 10 and count RC of rhythm counter 103 becomes 15 at SE08 of FIG. 14, namely, when the rhythm pattern for generating the next sound becomes the last step "15", the determination at SE08 becomes YES. After the determination at the next SA10 becomes NO (the value of ACR is 0 because the normal mode is selected), the value of pattern change standby flag PTF is returned to at SE12, control passes to SE06 where the final step 0 of the main rhythm pattern before the rhythm is switched is generated as a sound. When this operation ends and the rhythm reproduction at SA17 is again started through the loop of SA10–SA21 of FIG. 10, the determination at SE04 of FIG. 14 become YES because PTF is set to 0. Thus, those of the main rhythm patterns of FIG. 2 stored in pattern memory 106 of FIG. 1 and having a rhythm number corresponding to a new value indicated by rhythm number register RR are sequentially read, starting with step 0, at SE05 because the rhythm is switched. Thereafter, the rhythm sound is generated in the changed rhythm pattern. In this way, if the rhythm is switched halfway through execution of a main rhythm pattern of 16 steps, the rhythm sound continues to be generated in the main rhythm pattern employed before the rhythm is changed until a timing appropriate for separation of the rhythm pattern is encountered, and then a new main rhythm pattern starts.

If main rhythm patterns having the rhythm number are sequentially read, starting with step 0, and rhythm sounds are generated in the changed rhythm pattern in this way, picture advancement data is similarly read from step 0 on the basis of the time lengths of both the data. Thereafter, the changed picture advancement data is displayed.

When Fill-in SW is Depressed during Reproduction of only Rhythm Sound

The operation of this apparatus will be described below which is performed when the performer depresses fill-in SW 1056 of FIG. 3 during the normal mode display advancement process at SA25 and the rhythm reproduction process at SA14 through the loop of SA10–SA21. In this case, the rhythm sound is generated in the fill-in rhythm pattern from the time when the performer depresses fill-in SW 1056 to the fifteen step, and thereafter again in the main rhythm pattern.

Preparations for this switching are made in the various switching process at SA21 of FIG. 10. Namely, in FIG. 15, when the determination at SF01 becomes YES, control passes to SF17 where "1" is set in pattern register PR and it is then determined whether ACF=1. Since at this time the normal mode is involved, this determination becomes NO. Thus, the count RC of rhythm counter 103 of FIG. 1 is stored in GC (SF19) and the various switching operations at SA21 of FIG. 10 are terminated.

After the value of pattern register PR and the value of picture counter GC are changed, as mentioned above, the determinations at SA10, SA22 of FIG. 10 become NO, and the normal mode display process at SA25 and the rhythm reproduction process at SA14 and the normal mode display process at SA25 start.

The determination at SE01 becomes YES due to PR=1 and control passes to SE13 in FIG. 14. At SE13 a step corresponding to the count of rhythm counter 103 of FIG. 1 is read from that of the fill-in rhythm patterns of FIG. 22 stored in pattern memory 106 of FIG. 1 and having a rhythm number corresponding to the value indicated by rhythm number register RR.

Thereafter, control passes to SE06 where the rhythm sound is generated in the fill-in rhythm pattern until the value of RC is determined as being 15 at SE14.

In FIG. 19, the determination at SJ01 becomes YES because PR=1 and control passes to a process at SJ14, where a step indicated by picture counter GC is read from the fill-in picture advancement data of the normal mode fill-in picture advancement data of FIG. 7(A) stored in picture advancement memory 114 of FIG. 1 and having a rhythm # corresponding to the value indicated by rhythm number register PR. (At this time, GC is already set at SF19).

Thereafter, it is determined whether GNR=GD (SJ16). If this determination is NO, or only when the displayed picture is to be changed, the processes at SJ09, SJ10 are performed to change the contents of the picture number register and hence change the display.

FIG. 27(B) shows one example of the fill-in picture advancement data in the normal mode. This fill-in picture advancement data uses no sound length data GDO and is stored in each step which advances in a sixteenth note length (the minimum time length in the present embodiment). Namely, picture number data is stored in each step of the minimum time length such that picture number data corresponding to the switching of the fill-in which may occur at any time can be read immediately because it is indefinite which point in time the fill-in is switched at. Therefore, if the same picture is displayed for more than the minimum time length in the fill-in picture advancement data, the same picture number data GD continues as at steps SJ08–SJ11. If the same data is transferred to and displayed by display 115 in each sixteenth note length in such a case, the picture which displays the same image thereon would flicker. Thus, if the determination GNR=GD is YES, only the processes at SJ11 and SJ12 are performed to continuously display the same image.

As mentioned above, even if the rhythm is changed halfway through execution of the main rhythm pattern of 16 steps, the fill-in rhythm pattern and the fill-in picture are immediately selected. Thus, a fill-in effect is added to the rhythm sound under generation and a fill-in picture is displayed at the timing when the performer depresses fill-in SW 1056 of FIG. 3.

The normal mode display advancement process at SA25 and the rhythm reproduction process at SA14 are iterated through the loop of SA10–SA22–SA25–SA14–SA21 of FIG. 10. If the count of rhythm counter 103 of FIG. 1 becomes 15 at SE14 of FIG. 14, namely, when the rhythm pattern to be generated next comes to the last fifteenth step, the determination at SE14 of FIG. 14 becomes YES and control passes to SE15.

At SE15 the contents of pattern register PR are returned to 0 to prepare for return to the main rhythm pattern. Subsequently, the processes at SE16–SE18 are performed which are the processes in an auto code advancement mode to be described in more detail later. After these processes, control passes to SE06 where a rhythm sound in the final step of the fill-in rhythm pattern is generated.

After the above operations, when the rhythm reproduction at SA17 is again started through the loop of SA10–SA22–SA25–SA14–SA21–SA10 of FIG. 10, the determines at SE01–SE03 of FIG. 14 become NO because PR is set to 0 and thus the generation of a sound in the main rhythm pattern is recovered and the determinations at SJ01, SJ05, SJ06 of FIG. 10 also become NO and picture advancement in the normal mode main pattern is recovered.

When Ending SW is Depressed during Reproduction of only a Rhythm Sound

The operation of the apparatus will be described which is performed when the performer depresses ending SW 1057 of FIG. 3 during iteration of the normal mode display advancement at SA25 and the rhythm reproduction process at SA14 through the loop of SA10–SA22–SA25–SA14–SA21. In this case, the rhythm sound continues to be generated until the end of the main rhythm pattern appropriate for separation is encountered and the rhythm sound is then generated in the ending rhythm pattern of 16 steps to then terminate automatic accompaniment of the rhythm sound.

Preparations for this switching operation are made in the various switching operations at SA21 of FIG. 10. Namely, in FIG. 15, when the determination at SF02 becomes YES, control passes to SF15, where "3" is set in the pattern register PR and control then passes to SF07.

At SF07 it is determined whether the count RC of rhythm counter 103 of FIG. 1 is 0 or not, namely, whether the timing appropriate for separating the main rhythm pattern of the sixteenth step is now encountered.

At SF07 if the determination is YES or if the timing appropriate for separation is encountered, the determination at SF08 becomes NO and control passes to SF11, where the value of pattern change standby flag PTF is set to 0 and the various switching operations are terminated. Namely, the value of PTF becomes 0 at a timing appropriate for separation of the main rhythm pattern of 16 steps as in the rhythm switching operations during the rhythm sound reproduction.

If the determination at SF07 is NO, namely, when the main rhythm pattern of 16 steps is midway through its execution, control passes to SF14 where the value of pattern change standby flag PTF is set and the various switching operations are terminated. The value of PTF becomes 1 when the main rhythm pattern of 16 steps is midway through its execution as in the rhythm switching operation.

In this way, after the value of pattern register PR is changed and the value of pattern change standby flag PTF is set, the determinations at SA10, SA22 of FIG. 10 becomes NO to again start the normal mode display advancement process at SA25 and the rhythm reproduction process at SA14.

Then, the determination at SE03 of FIG. 14 becomes YES and control passes to SE19 for the process for the ending rhythm pattern.

If ending rhythm SW 1057 of FIG. 3 is depressed at a timing appropriate for separation of the main rhythm pattern of 16 steps, the determination at SE06 becomes YES because the value of pattern change standby flag PTF is 0. Therefore, those of the ending rhythm pattern of FIG. 22 stored in pattern memory 106 of FIG. 1 and having a rhythm number corresponding to the value indicated by rhythm number register RR are sequentially read, starting with step 0, at SA21. Thereafter, control passes to SE06 where a rhythm sound is generated in the ending rhythm pattern until the value of RC 103 is determined as being 15 at SE22.

The rhythm reproduction process at SA17 is iterated through the loop of SA10–SA22–SA25–SA14–SA21 of FIG. 10. When the value of RC becomes 15, namely, when the rhythm pattern to be generated next as a sound becomes the final fifteenth step, the determination at SE22 becomes YES and the final step of the ending rhythm pattern is generated as a sound at SE23.

After this operation, control jumps from SE23 to SF20 through a route (3) of FIG. 15 in the various switching operations at SA18 of FIG. 10. Since the determination at SF20 becomes NO (the value of ACF is 0 in the normal mode), control jumps to the process including SB03 and subsequent blocks through a route (1) of FIG. 11 in SA01 of FIG. 10 to thereby terminate the automatic accompaniment. After this process, and after the initial process at SA01 of FIG. 10 (the processes at SB03 and subsequent blocks of FIG. 11), the processes at SA02–SA07 are iterated until any one of auto chord advancement SW 1052, introduction SW 1053 and start SW 1054 of FIG. 3 is depressed. If initialization of rhythm number register RR and tempo data register TR at SB01 and SB02 of FIG. 11 is not performed and start SW 1054, for example, is then depressed, automatic accompaniment starts with the rhythm number and tempo maintained so far.

In FIG. 19, the determination at SJ06 becomes YES, control passes to SJ13, where the GC step of a rhythm # indicated by RR and of the normal mode ending picture advancement data (FIG. 7(A)) is read, and subsequent processes at SJ08, SJ09 and SJ10 are performed as mentioned above, to thereby display the normal mode ending picture on display 115.

If ending SW 1057 of FIG. 3 is depressed during execution of the main rhythm pattern of 16 steps, the determination at SE19 of FIG. 14 becomes NO and control passes to SE20 because the value of pattern change standby flag PTF is 1.

AT SE20 a step corresponding to the count RC of rhythm counter 103 of FIG. 1 is read from that of the main rhythm patterns of FIG. 22 stored in pattern memory 106 of FIG. 1 and having a rhythm number corresponding to the value indicated by rhythm number register RR. Namely, a rhythm sound is generated in the main pattern at SE06 until the count RC of rhythm counter 103 of FIG. 1 is determined as being 15 at SE08.

The normal mode display advancement process at SA25 and the rhythm reproduction process at SA14 are iterated through the loop of SA10–SA22–SA25–SA14–SA21 of FIG. 10. Thus, when the count RC of rhythm counter 103 becomes 15 at SE08 of FIG. 14, namely, when the rhythm pattern to be generated as a sound next becomes the final fifteenth step, the determination at SE08 becomes YES. After the determination at SE09 becomes NO (the value of ACF is 0 because the normal mode is involved), the value of pattern change standby flag PTF is returned to 0 at SE12, and control passes to SE06, where the final step of the main rhythm pattern is generated as a sound.

After this operation, and when the normal mode display advancement process at SA22 and the rhythm reproduction process at SA14 start again through the loop of SA10–SA22–SA25–SA14–SA21 of FIG. 10, the determination at SE19 of FIG. 14 becomes YES because PTF is set to 0, and the subsequent 16 steps are generated as rhythm sounds in the ending rhythm pattern by the processes at SE19–SE21–SE22–SE06.

For the image displayed on display 115, when ending SW 1057 is depressed, the determination at SF02 of FIG. 15 becomes YES, so that "3" is set at SF15. At this time, the determination at SJ06 of FIG. 19 becomes YES, and display of the ending image using ending picture advancement data starts.

Generation of the rhythm sounds is iterated. Thus, when the value of RC becomes 15, the determination at SE22 becomes YES, and final step of the ending rhythm pattern is generated as a sound at SE23. Thereafter, the operation of the automatic accompaniment is terminated and the image display is also terminated in quite the same manner as mentioned above.

Reproduction of only a Rhythm Sound Started by Introduction SW

The operation of the apparatus will be described which is performed when the performer depresses introduction SW 1053 of FIG. 3 to start the normal mode advancement process at SA25 and the rhythm reproduction process at SA14 through the loop of SA10→SA22→SA25→SA14–SA21. In this case, rhythm sounds for 16 steps are initially generated in the introduction rhythm pattern and generation of a rhythm sound is then started in the main rhythm pattern.

When the performer depresses introduction SW 1053 of FIG. 3 in the standby state using the process loop of SA02–SA07 of FIG. 10, the determination at SA06 becomes YES and control passes to SA08, where the value "2" is set in pattern register PR to result in the introduction rhythm pattern mode. Thereafter, the respective determinations at SA10, SA22 become NO as in the case occurring when start SW 1054 (FIG. 3) is depressed and the normal mode display advancement process at SA25 and the rhythm reproduction process at SA14 start.

In this case, the determination at SE02 of FIG. 14 becomes YES and control passes to SE27, where those of the introduction rhythm patterns of FIG. 22 stored in pattern memory 106 of FIG. 1 and having a rhythm number corresponding to the value indicated by rhythm number register RR are sequentially read, starting with step 0.

Thereafter, control passes to SE06, where the rhythm sound is generated in the introduction rhythm pattern until the value of RC of counter 103 of FIG. 1 is determined as being 15 at SE28.

The rhythm reproduction process at SA14 is iterated through the loop of SA10→SA22→SA25→SA14–SA21 of FIG. 10 on the basis of the above operations.

In FIG. 19, the determination at SJ01 becomes NO, the determination at SJ02 becomes YES (see SB11 in FIG. 11), the determination at SJ03 become NO (since the introduction has started) and control passes to SJ05, where the determination becomes YES. Therefore, control passes to SJ15, where the GC step of the normal mode introduction picture advancement data shown in FIG. 7(A) and having a rhythm # indicated by the rhythm number register RR is read. Subsequently, control passes in the sequence of SJ08→SJ09→SJ10→SJ11→SJ12 to indicate a picture for each step on display 115.

If the count RC of rhythm counter 103 becomes "15" at SA28 of FIG. 14, namely, if the rhythm pattern to be generated becomes the final fifteenth step, the determination at SA28 of FIG. 14 becomes YES and control passes to SA29, where the contents of pattern register PR are changed to 0 for preparing for passing to the main rhythm pattern. After this processing, it is determined whether AFC=1 (SE30). At this time, the normal mode is involved, so that the determination at SE30 becomes NO. Therefore, "0" is stored in GC and GOC (SE31). Control then passes to SE06, where the final step of the introduction rhythm pattern is generated as a sound. Therefore, when the automatic accompaniment of the introduction rhythm pattern is terminated, "0" is set in both GC and GCO.

When the normal mode display process at SA25 and the rhythm reproduction process at SA14 again start through the loop of SA10→SA22→SA25→SA14–SA21 of FIG. 10 after the above operation, the respective determines at SJ01, SJ05 and SJ06 of FIG. 19 become NO because PR is set to 0 at SE29 of FIG. 14. Therefore, control passes to a display operation in the normal mode main pattern. Since PR is set to 0, the determinations at SE01–SE03 of FIG. 9 become NO and hence control passes to generation of a sound in the main rhythm pattern.

As described above, the performer depresses introduction SW 1053 of FIG. 3 at the start of the automatic accompaniment to easily add an introduction effect to the rhythm pattern and display an introduction picture on display 115.

When Stop SW is Depressed during Reproduction of only a Rhythm Sound

The operation of the apparatus performed when the performer depresses stop SW 1055 of FIG. 3 during iteration of the normal mode display advancement process and rhythm reproduction process through the loop of SA10→SA22→SA25→SA14–SA21 will be described.

In this case, the determination at SF03 of FIG. 15 becomes YES in the various switching operations at SA21 of FIG. 10, and control then passes to SF20, where the determination becomes NO (the value of ACF is 0 in the normal mode), so that control jumps to a process group including SB03 and subsequent processes through the route (1) in FIG. 11 in SA01 of FIG. 10 from SF20 to terminate the automatic accompaniment and simultaneously the display on display 115. The subsequent processes are the same as those performed when ending SW 1057 of FIG. 3 is depressed.

When an Accompaniment Key is Depressed during Reproduction of only a Rhythm Sound The operation of the apparatus performed when the performer depresses any one of accompaniment keys 1042 between $C_2$–$C_4$ of FIG. 2 on keyboard 104 of FIG. 1 during iteration of the rhythm reproduction process through the loop of SA10→SA22→SA25→SA14–SA21 will be described.

In this case, key data KI shown in FIG. 4 and corresponding to the depressed accompaniment key is input to CPU 101 of FIG. 1 from keyboard 104.

This input is detected at SA22 of FIG. 10 during generation of a rhythm sound and the determination becomes YES.

Thus, first, accompaniment flag BF is set to "1" at SA23 and control passes to the accompaniment mode.

Subsequently, chord judgment is made at SA24. Namely, when chord judge unit 108 receives key data KI from CPU 101 of FIG. 1, it discriminates key chord KC and octave chord OC in key data KI and the root and chord of the depressed accompaniment key.

The normal mode display advancement process is then made (SA25). Thereafter, it is determined whether BF=1 (SA14), and the bass sound reproduction process is performed at SA15 because the determination at SA14 becomes YES due to the process at SA23. The process at SA15 involves accompaniment by a bass sound at the musical interval of the root determined by chord judge unit 108 of FIG. 1 and is similar to the rhythm reproduction process at SA14 in addition to the designation of the musical interval. Therefore, the details of this process are similar to those of the rhythm reproduction process of FIG. 9.

Figure 23C:
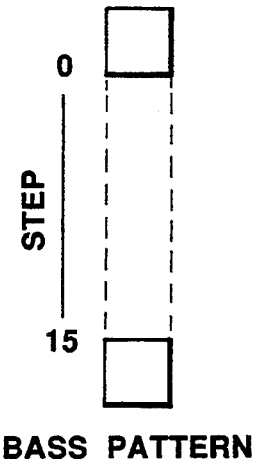

In this case, a bass pattern having a structure similar to that of the rhythm pattern shown in FIG. 22 is stored in pattern memory 106 of FIG. 1. The bass pattern includes four patterns: namely, a main pattern, a fill-in pattern, an introduction pattern and an ending pattern. Each pattern includes 6 rhythms #1–#6 of 16 steps. FIG. 23(C) shows the bass pattern of 16 steps of FIG. 22. As shown, whether one kind of bass sound is to be generated in each step can be designated in a binary number of 0 or 1.

When the bass reproduction process at SA15 of FIG. 10 is performed in a manner similar to the rhythm reproduction process at SA17 in the above arrangement, reproduction of a bass sound on the basis of the main bass pattern fill-in bass pattern, ending bass pattern and introduction bass pattern is performed synchronously with the reproduction of the rhythm sound on the basis of the main rhythm pattern, fill-in rhythm pattern, ending rhythm pattern and introduction rhythm pattern. Namely, the reproduction of the bass sound by fill-in SW 1056, ending SW 1057 and introduction SW 1053 of FIG. 3 is exactly the same as reproduction of the rhythm sound.

Generation of a bass sound (of monotony) is performed by accompaniment sound generator 110 of FIG. 1 and generation of a chord to be described in more detail later is also generated by accompaniment sound generator 110, so that accompaniment sound generator 110 is arranged so as to generate a plurality of musical sounds in parallel in a time division manner.

The chord sound is reproduced at SA16. This process involves accompaniment of a chord determined by chord judge unit 108 of FIG. 1 and is similar to the rhythm reproduction process at SA17 in addition to chord designation. Therefore, the details of the chord sound reproduction are similar to those of the rhythm reproduction process of FIG. 14 as in the bass sound reproduction.

In this case, pattern memory 106 of FIG. 1 stores a chord pattern having a structure similar to that of the rhythm pattern of FIG. 22. FIG. 23(*b*) shows chord patterns each of 16 steps. As shown in FIG. 23(*b*), whether one kind of chord sound (3–4 sounds are generated simultaneously as a chord sound) is to be generated in each step in the automatic accompaniment is designatable with a binary number of 0 or 1.

Reproduction of a chord sound on the basis of the main chord pattern, fill-in chord pattern, ending chord pattern and introduction chord pattern is performed synchronously with reproduction of a rhythm sound on the basis of the main rhythm pattern, fill-in rhythm pattern, ending rhythm pattern and introduction rhythm pattern since the chord reproduction at SA16 of FIG. 10 is similar to the rhythm reproduction at SA17 in the above arrangement. The chord sound reproduction by fill-in SW 1056, ending SW 1057, or introduction SW 1053 of FIG. 3 is quite similar to reproduction of the rhythm sound.

The reproduction of the chord sound is performed by accompaniment sound generator 110 of FIG. 1, as mentioned above. In this case, since the chord sound is usually made of 3–4 sounds, these sounds are generated in parallel in a time division manner.

After key data KI is once input through accompaniment key 1042 (FIG. 2) at SA22 of FIG. 10 in the reproduction of the bass sound and chord sound, in-accompaniment flag BF is set to 1 at SA23, so that the determination at SA10 becomes YES from the next step. In addition, the determination at SE11 becomes NO (the value of ACF is 0 because the normal mode is involved), and chord judgment is made at directly SA24. Therefore, unless new key data KI is input in the reproduction of the bass sound and chord sound in each step through iterative processes involving the loop of SA10–SA21, generation of a sound is iterated at the musical interval and chord of the same root. If the performer newly depresses accompaniment key 1042 of FIG. 2, the note and chord are changed to those of the corresponding root.

As mentioned above, when the performer depresses accompaniment key 1042 of FIG. 2 in the rhythm sound reproduction, the rhythm sound, bass sound and chord sound are generated while iterating a pattern of 16 steps independent of each other. When the performer depresses accompaniment keys 1042 successively, the musical interval of the bass sound and the chord type of the chord sound are changed correspondingly to thereby perform automatic accompaniment.

The normal mode advancement process of FIG. 19 is performed on display 115 and the display advances irrespective of the operation of accompaniment key 1042.

[The Details of Auto Chord Advancement Mode Operation]

The details of the operation of the apparatus in the auto chord advancement mode in the automatic accompaniment will be described.

Auto Chord Advancement Mode Process

Figure 16:
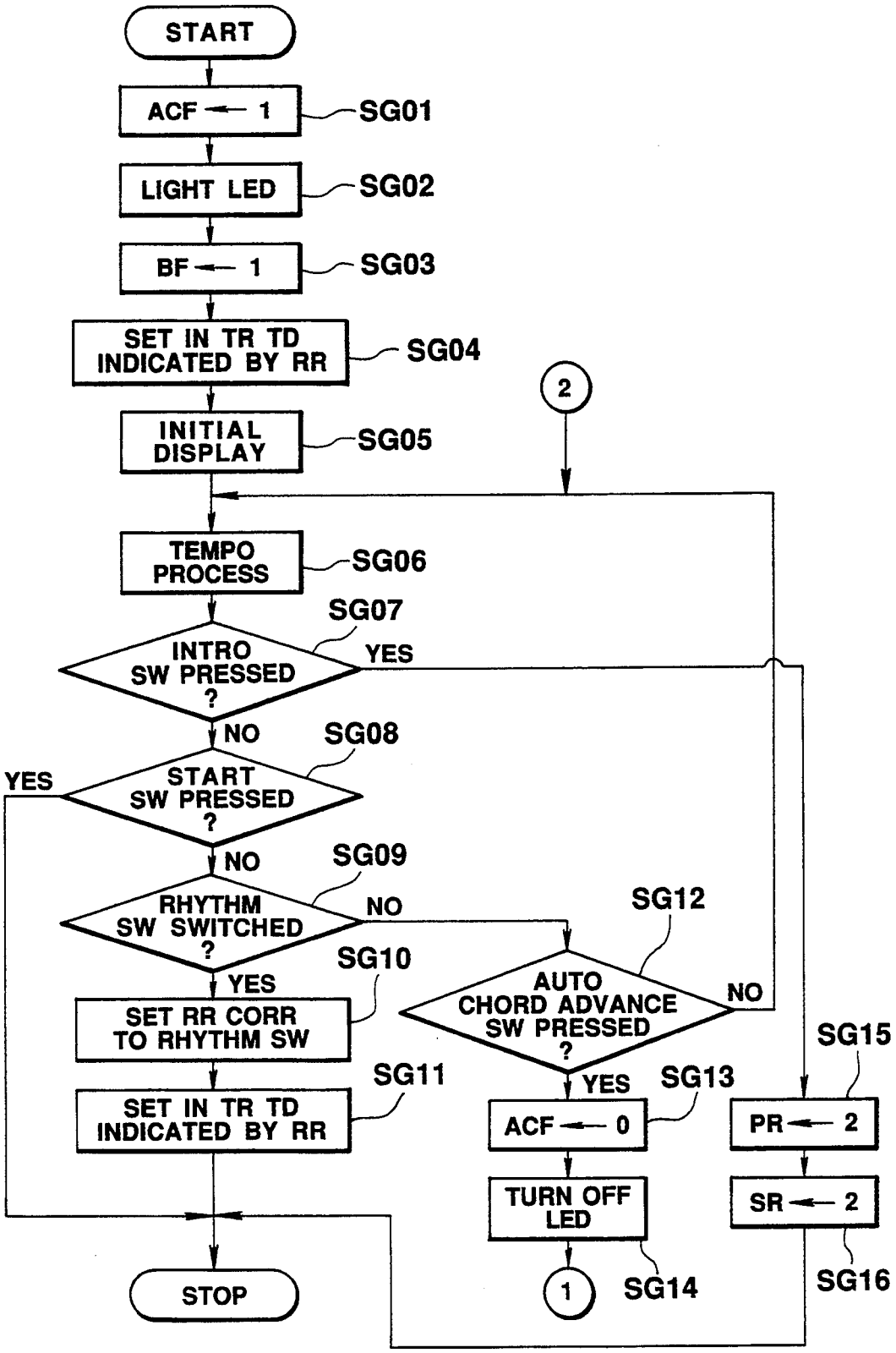
FIG. 16 is a flowchart indicative of an auto chord advancement mode operation of the embodiment.

First, when the performer turns on a power supply for the apparatus (not shown) and depresses auto chord advancement SW 1052 of FIG. 3 in the standby state described in the normal mode, namely, in the iteration of SA02–SA07 of FIG. 10, the determination at SA05 becomes YES and thus control passes to the auto chord advancement mode process at SA09, which is a process in the standby state before the auto chord advancement starts and the details of this process are shown in FIG. 16.

First, at SG01 the value "1" indicative of the auto chord advancement mode is set in auto chord advancement flag ACF.

At SG02 the LCD located above auto chord advancement SW 1052 of FIG. 3 is lighted to inform the performer of selection of the auto chord advancement mode.

Subsequently, at SG03 the value "1" is set in in-accompaniment flag BF, indicating that accompaniment is now being played. This is because accompaniment by the bass sound and chord sound is necessarily played in the auto chord advancement mode.

At SG04 tempo data TD corresponding to a rhythm number designated by rhythm number register RR at present is set in tempo data register TR. Tempo data TD is now stored as a rhythm header in chord advancement memory 107 of FIG. 1 in correspondence to each of rhythm numbers #1–#6 shown in FIG. 24. The details of tempo data TD are shown in FIG. 25. As shown in FIG. 25, tempo data TD is binary data of 5 bits which permit to designate tempos 0–31. Since there are tempo data TD items corresponding to the respective rhythm numbers, each time the performer switches rhythm SW 1051 of FIG. 3, the tempo data TD corresponding to the selected rhythm number is read from the rhythm header of chord advancement memory 107 of FIG. 1 and set in tempo data register TR in order to set an optimal tempo automatically when the rhythm is switched from one to another because, for example, rock has a high tempo, and waltz has a relatively low tempo.

At SG05 the initial display process is performed the contents of which are outlined in FIG. 18.

After the processes at SG01–SG05, processes SG06–SG12 are iterated until any one of the switches is switched on. When the performer depresses any one of introduction SW 1053 start SW 1054, and rhythm SW 1051 of FIG. 3 in the respective determinations at SG07, SG08 and SG09 in the auto chord advancement mode, the corresponding auto chord advancement mode starts, which will be described in more detail later.

The process at SG06 is the one which permits the performer to depress tempo up SW 1058 or tempo down SW 1059 of FIG. 3 during standby in the auto chord advancement mode to arbitrarily change the tempo of a new automatic accompaniment, and is similar to the tempo process at SA02 of FIG. 10 (see FIG. 12).

The process SG12 is the one which when the performer once again depresses auto chord advancement SW 1052 of FIG. 3 during standby in the auto chord advancement mode, causes the operation to return to the initial state out of the auto chord advancement mode. Namely, when auto chord advancement SW 1052 is depressed, the determination at SG12 becomes YES and the value of auto chord advancement flag ACF is returned to 0 and hence to the normal mode at SG13. Furthermore, at SG14 the LED shown above auto chord advancement SW 052 of FIG. 3 is turned off. After these operations, control jumps to the process including SB03 and subsequent blocks through the route (1) in FIG. 11 in SA01 of FIG. 10 from SG14 to thereby terminate the automatic accompaniment. The subsequent processes are similar to those for the automatic accompaniment termination performed when the performer depresses ending SW 1057 of FIG. 3 in the normal mode.

Auto Chord Advancement Process

When the performer depresses any one of start SW 1054 and rhythm SW 1051 during standby in the auto chord advancement mode at SG06–SG12 of FIG. 16, the auto chord advancement process starts. The operation of the apparatus performed when introduction SW 1053 is depressed will be described later.

First, when start SW 1054 is depressed, the determination at SG08 becomes YES to terminate the auto chord advancement mode process at SE09 of FIG. 10 and control passes to the auto chord advancement process at SE12.

If any one of rhythm SWs 1051 is depressed, the determination at SG09 becomes YES and control passes to SG10, where a value corresponding to the rhythm number of rhythm SW 1051 depressed is set in rhythm number register PR to switch the rhythm. At SG11 tempo data TD corresponding to the rhythm number set in rhythm number register PR is set in tempo data register TR as in the operation at SG04. After these processes, the auto chord advancement mode process at SA12 of FIG. 10 is terminated and control passes to the auto chord advancement display process at SA13.

As mentioned above, when start SW 1054 or rhythm SW 1051 is depressed and hence the auto chord advancement process at SA12 of FIG. 10 starts, the processes at SA10–SA21 of FIG. 10 are thereafter iterated each time the count RC of rhythm counter 103 is incremented by a timer clock from timer clock generator 102 of FIG. 1. In this case, the determination at SA10 becomes YES because in-accompaniment flag BF is set to 1 at SG03 of FIG. 16. The determination at SA11 become YES because auto chord advancement flag ACF is set to 1 at SG01 of FIG. 16. Therefore, the loop process of SA10→SA11→SA12→SE13→SA14–SA21→SA10 is iterated in the auto chord advancement process. Next, this process will be described.

First, in the loop of SA10–SA21, the rhythm reproduction process at SA17 is quite similar to the rhythm reproduction process in the normal mode and generation of a rhythm sound is iterated in the rhythm pattern of 16 steps. The bass reproduction process at SA15 and the chord reproduction process at SA16 are similar to the process performed when the performer depresses accompaniment key 1042 of FIG. 2 in the normal mode, and accompaniment of the bass sound and chord sound is iterated in the bass pattern and chord pattern of 16 steps in an independent manner. For example, generation of a rhythm sound in the same rhythm pattern, generation of a bass sound in the same bass pattern and generation of a chord sound in the same chord pattern for each measure are iterated. The rhythm pattern, bass pattern and chord pattern are independent of each other.

Designation of a musical interval in the bass reproduction process and the type of a chord in the chord reproduction process in the above operation is made by the performer's sequential designation through accompaniment key 1042 of FIG. 2 in the normal mode while these designations are automatically made through a plurality of measures in the auto chord advancement mode to thereby greatly alleviate the load on the performer, which is a big feature.

Figure 24:
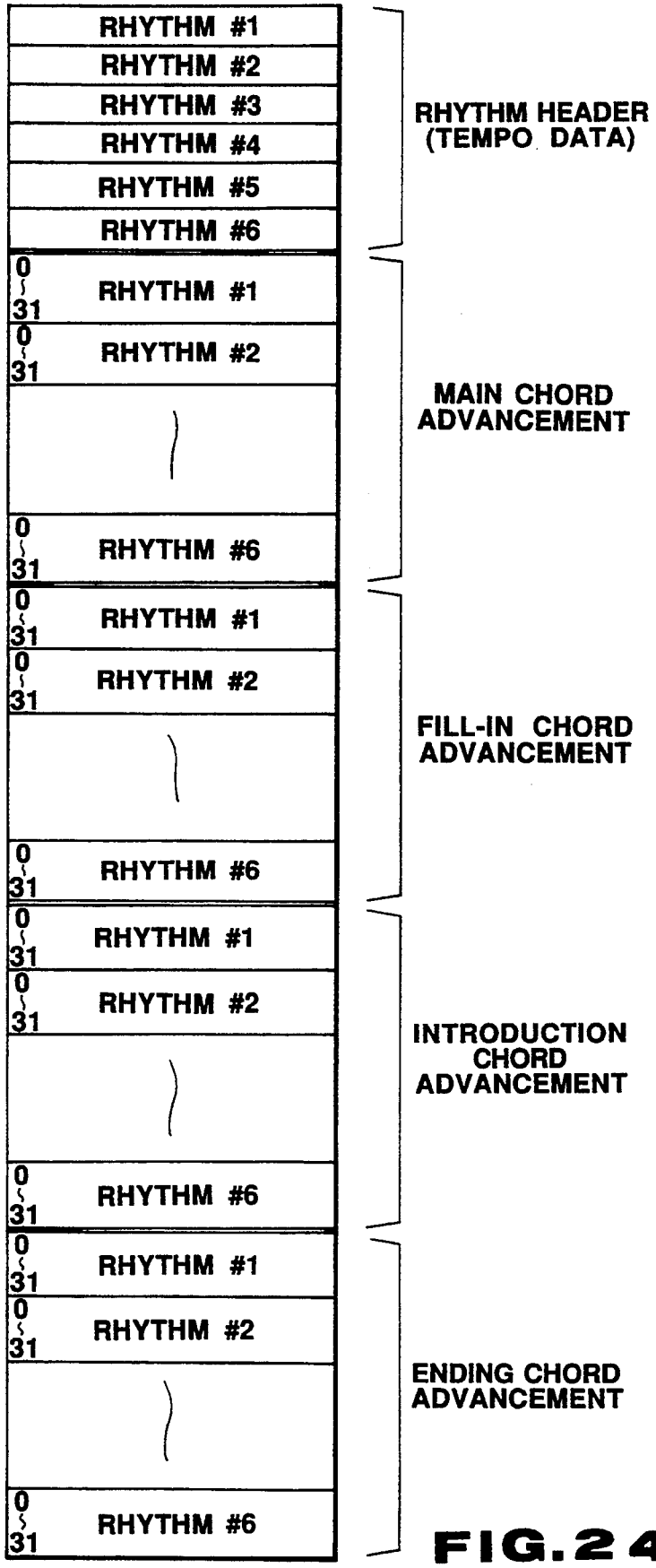
FIG. 24 is a schematic of a chord advancement memory.
Figures 25, 26:
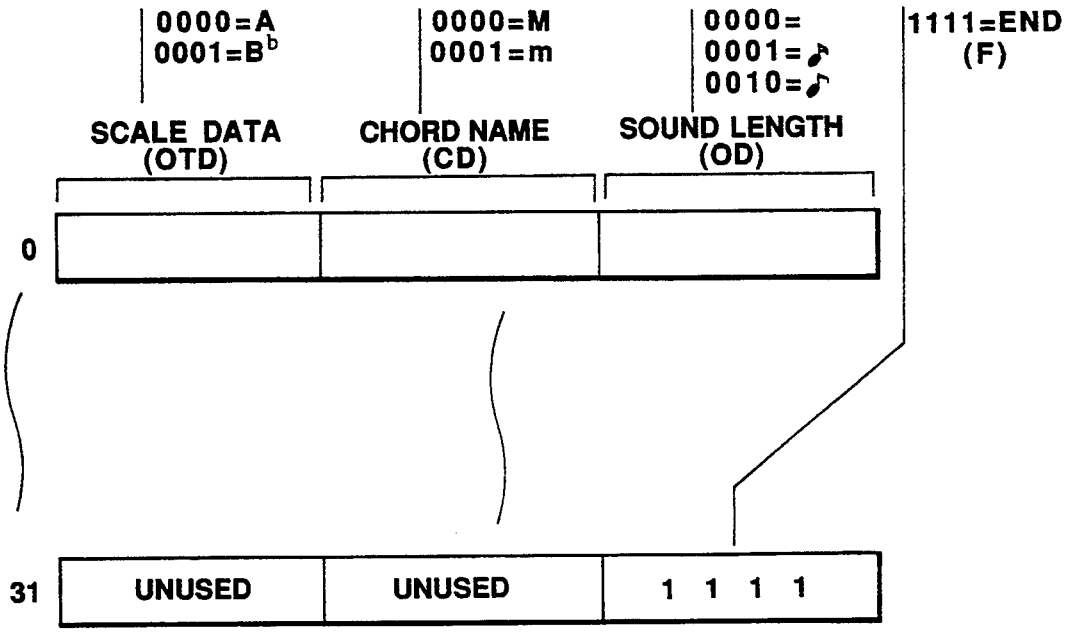
FIG. 25 shows the structure of tempo data.
FIG. 26 shows the structure of each chord advancement data.

In order to realize the above operation, chord advancement memory 107 connected to CPU 101 of FIG. 1 stores chord advancement data having a structure shown in FIG. 24. As shown in FIG. 24, the chord advancement data includes four kinds of data; namely, main chord advancement, fill-in chord advancement, introduction chord advancement and ending chord advancement data items, each chord advancement data including six rhythms #1–#6 of 32 steps 0–31.

FIG. 26 shows chord advancement data of 32 steps of FIG. 24. Musical scale data OTD designates the name of a musical scale such as A or F using binary data of 4 bits. Chord name data CD designates one of minor (m), major (M), seventh, etc., using binary data of 4 bits. Therefore, the type of a chord for each step is determined by musical scale data OTD and chord name data CD. Sound length data OD designates how long each chord is to be generated using binary data of 4 bits. The minimum unit of duration of each chord is one step, for example, of a rhythm pattern and corresponds to a sixteenth note, eighth note . . . Sound length data OD for each step is subtracted during generation of a sound, as will be described in more detail later, and can be 0 at which time control passes to the next step. Data "1111" ("F" in a hexadecimal) indicative of the end is contained in the sound length data OD of an appropriate one of the first to 31th step, as shown in FIG. 26 (for example, the data "1111" is shown in the 31 step in FIG. 26), and the type of a chord having any step length is designated by any one of the steps following the appropriate one.

In this case, the concept of the step in FIG. 24 or 26 differs from the step in the rhythm pattern, bass pattern and chord pattern in FIG. 22 or 23. One step of the chord advancement data corresponds to a plurality of steps of the rhythm pattern, etc., prescribed by the sound length data OD, as mentioned above. In order to discriminate these steps, the step of the rhythm pattern, etc., is referred to as a pattern step, the step of the chord advancement data is referred to as the chord step. Therefore, the bass pattern and chord pattern each iterate 16 pattern steps for each measure while in the chord advancement data which prescribes the bass musical interval and the type of chord at that time, automatic accompaniment advances in the auto chord advancement mode while making chord designation, for example, such that the first 8 pattern steps of the first measure as C, the next 8 pattern steps as Am, the first 8 pattern steps of a second measure as F, the next 4 pattern steps as $G_7$ and the last 4 steps as C where C denotes the chord of the 0th chord step having a sound length of 8; Am denotes the chord of the first chord step having a sound length of 8; F denotes the chord of the second chord step having a sound length of 8; $G_7$ denotes the chord of the third chord step having a sound length of 4; C denotes the chord of the fourth chord step having a sound length of 4, . . . The designation of the bass musical interval is made, for example, by the root (the first sound) of each chord.

Figure 17:
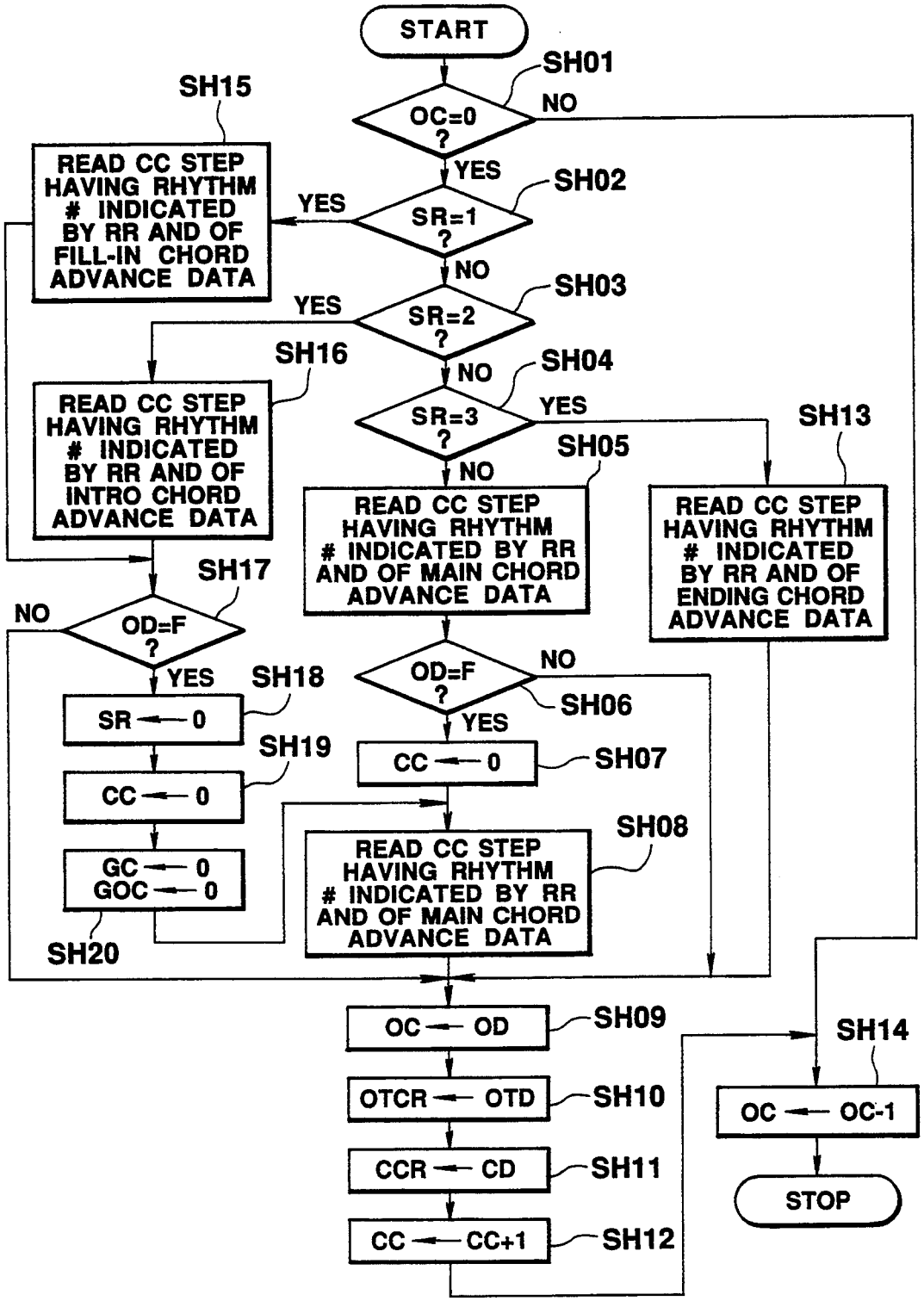
FIG. 17 is a flowchart indicative of an auto chord advancement mode operation of the embodiment.

The details of SA12 of FIG. 10 to realize the chord designation are shown in FIG. 17.

First, the determination at SH01 initially becomes YES because sound length counter OC is initialized to 0 in the initialization at SA01 of FIG. 10 (SB09 in FIG. 11).

At SH02, SH03 and SH04 it is determined whether the value of advancement register SR is 1, 2 or 3, or whether the chord advancement to be automatically accompanied is fill-in chord advancement, introduction chord advancement or ending chord advancement. When the performer has depressed start SW 1054 or rhythm SW 1051 of FIG. 3, advancement register SR is initially set to 0 by the initialization at SA01 of FIG. 10 (SB06 in FIG. 11), so that the main chord advancement is initially made and all the determinations at SH02–SH04 become NO and control passes to SH05.

At SH05 a chord step is read which is indicative of the count of chord counter CC from that of the main chord advancement data of FIG. 24 stored in chord advancement memory 107 in FIG. 1 and corresponding to a rhythm number indicated by the rhythm number register RR. Since chord counter CC is now set initially to 0 by the initialization at SA01 of FIG. 10 (SB10 in FIG. 11), the chord advancement data in the 0th chord step is initially read.

The determination at SH06 becomes NO until the final step is encountered and control passes to SH09. At this step the sound length data OD of the 0th chord step (see FIG. 13) is set in sound length counter OC, musical scale data OTD of the 0th chord step is set in musical scale chord register OTCR at SH10, and chord name data CD is set in chord name register CCR at SH11. Thus, designation of the type of chord corresponding to the 0th chord step is completed.

After the above processing, the count of chord counter CC is incremented by one at SH12 and the count of sound length counter OC is decremented by one at SH14, and the auto chord advancement process at SA12 of FIG. 10 is terminated.

Figure 20:
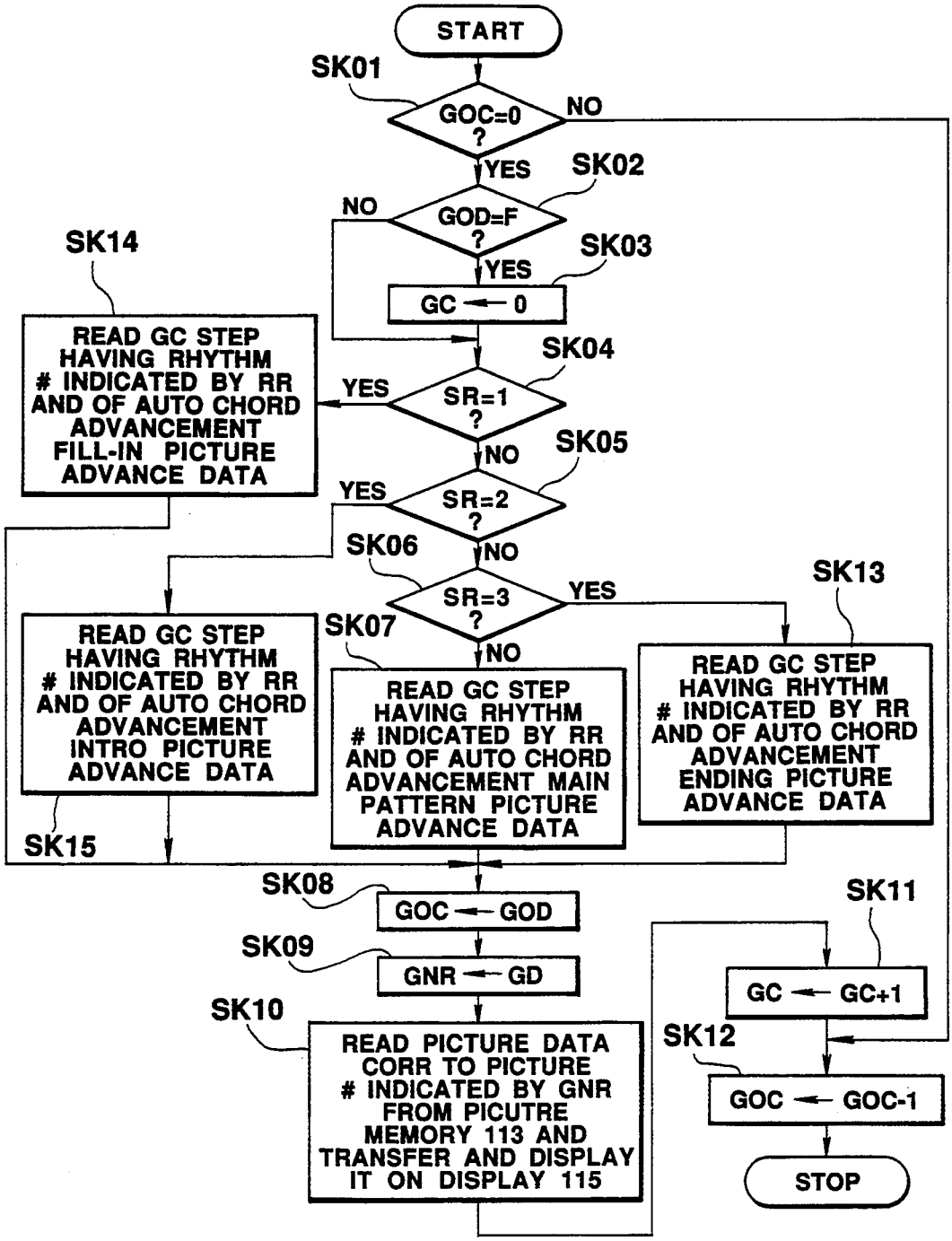
FIG. 20 is a flowchart indicative of the display advancing operation of the embodiment for the auto chord advancement.
Figure 21A:
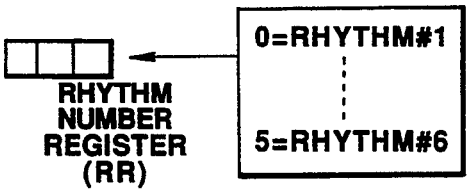
FIGS. 21(*a*)-(*o*) are a schematic of a flag counter register (FCR) group.
Figure 21B:
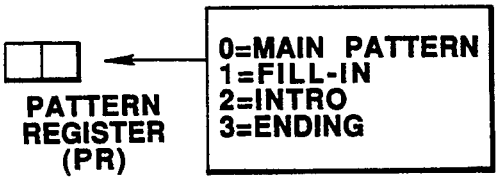
Figure 21C:
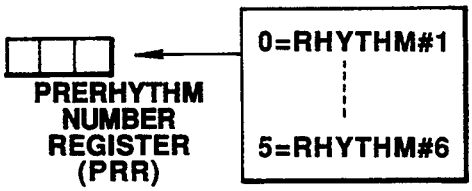
Figure 21D:
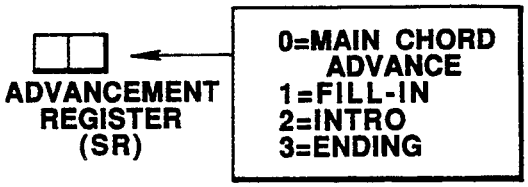
Figure 21E:
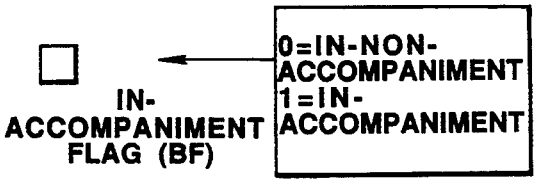
Figure 21F:
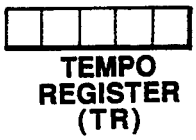

At SA13 subsequent to SA12 the auto chord advancement display advancement process is performed, the details of which are shown in FIG. 20. Namely, it is determined at SK01 whether the count of picture sound length counter GOC is "0" or not. If the determination is YES, it is determined at SK02 whether sound length data GOD is "F". If this determination is YES, picture counter GC is set to "0" (SK03) and it is then determined whether SR=1 (SK04), whether SR=2 (SK05), or whether SR=3 (SK06). If all the determinations at SK04–SK06 are NO, the main pattern is involved, so that the GC step of the auto chord advancement main pattern picture advancement data and having a rhythm # indicated by RR is read (SK07). The subsequent processes SK09–SK12 are similar to those at SJ08–SJ12 of FIG. 19.

The operation of the apparatus performed when the determinations at SK04, SK05 and SK06 are YES will be described later.

After the above processes, it is determined at SA14 whether BF=1. If this determination is YES, the bass reproduction is made at SA15. At this time, a musical scale corresponding to musical scale data OTD of the 0th chord step set in musical scale chord register OTCR is designated.

The chord reproduction is made at SA16 at which time the type of the chord is designated on the basis of the musical scale data OTD of the 0th chord step set in musical scale chord register OTCR and chord name data CD set in chord name register CCR.

The rhythm reproduction is made at SA17 of FIG. 10 in addition to the bass reproduction and the chord reproduction, so that automatic accompaniment for one pattern step is completed.

Thereafter, a timer clock is received from timer clock generator 102 of FIG. 1 by repetition of SA18, so that RC of counter 103 of FIG. 1 is incremented at SA19. After the processes at SA20, SA21 are completed (as mentioned above) the determinations at SA10, SA11 become YES and the auto chord advancement process starts again at SA12. In this case, since at SH01 of FIG. 17 sound length data OD of the 0th chord step is set previously in sound length counter OC, the determination at SH01 becomes NO until the count of sound length counter 0C becomes 0. In this case, at SH14 only the process for decrementing the count of sound length counter OC by one is performed and the auto chord advancement process at SA12 of FIG. 10 is terminated. Therefore, in the bass reproduction process at SA15 and the chord reproduction process at SA16 of FIG. 10, a musical scale and the type of a chord are designated which are similar to those in the preceding pattern step.

SJ01 of FIG. 20 is similarly performed. Since picture sound length data GOD of the 0th step is set last in picture sound length counter GOC, the determination at SJ02 becomes NO until the count of picture sound length counter GOC becomes 0. Thus, only the process for decrementing the count of picture sound length counter GOC by one is performed at SJ12 and the auto chord advancement display advancement process at SA13 of FIG. 10 is terminated.

The above state is iterated until the count of sound length counter OC is decremented into 0, namely, until the pattern step for the sound length data OD of the 0th chord step is iterated, during which time the same image continues to be displayed on display 115.

When the count of sound length counter OC is determined as 0 at SH01 of FIG. 17, and the determinations at SH02–SH04 become NO, a chord step of the main chord advancement data corresponding to the rhythm number indicated by rhythm number register RR and indicated by the count of chord counter CC is read at SH05. Chord counter CC now indicates the value "1" because it is incremented by one at the beginning of reading at the 0th step at SH12. Therefore, the chord advancement data of the first chord step is read here. The contents of sound length counter OC, musical scale chord register OTCR and chord name register CCR are set to those corresponding to the chord advancement data of the first chord step at SH09–SH11 as at the 0th chord step, the count of chord counter CC is incremented by one at SH12, the count of sound length counter OC is decremented by one at SH14, and the auto chord advancement process at SA12 of FIG. 10 is terminated.

A musical scale and the type of a chord are designated by the above process on the basis of musical scale data OTD and chord name data CD of the first chord step in the bass reproduction process SA15 and the chord reproduction process at SA16 in FIG. 10. This situation continues until the pattern step for sound length data OD of the first step is iterated.

The above operation is iterated while the respective chord steps of the main chord advancement data are being read sequentially, and the final chord step of the main chord advancement data is read at SH05 of FIG. 12. At this time, sound length data OD is "F" in a hexadecimal notation, as mentioned above, so that the determination at SH06 becomes YES. Thus, chord counter CC is reset to 0 at SH07 and the chord advancement data of the 0th chord step is read again at SH08 and the processes at SH09 and subsequent blocks are iterated.

Therefore, when the main chord advancement data is read to the final chord step, this chord step is not read and control returns to the 0th chord step to iterate the same chord advancement process.

When the count of picture sound length counter GOC is determined as 0 at SK01 of FIG. 20, control passes to SK02, where it is determined whether GOD=F. If so, GC is set to 0. If otherwise, and after the determinations at SK04–SK06 become NO, at SK07 the step is read which is indicated by the count of picture counter GC and of the main pattern picture advancement data of the auto chord advancement main pattern picture advancement data and corresponding to a rhythm # indicated by rhythm number register RR. Picture counter GC shows the value "1" since it has been incremented by one at the beginning of reading the 0th step at SK11. Therefore, the picture advancement data of the first step is here read. Like the 0th chord step, the contents of picture sound length counter GOC and picture number register GCR are set to values corresponding to the picture advancement data of the first step, and the picture # portion of picture memory 13 indicated by GNR is read and transferred to and displayed by display 115 at SK08–SK12. At SK11 the count of picture counter GC is incremented by one, at SK12 the count of picture sound length counter GOC is decremented by one and the auto chord advancement process at SA13 of FIG. 10 is terminated.

The musical scale and the type of a chord are designated by the above processes on the basis of the musical scale data OTD and chord name data CD of the first chord step in the bass reproduction process at SA15 and the chord reproduction process at SA16 in FIG. 10. This situation continues until the pattern steps for the sound length data OD of the first step are iterated.

The above operations are iterated while the respective chord steps of the main chord advancement data are being sequentially read. When the final chord step of the main chord advancement data is read at SH05 of FIG. 17, the sound length data OD is "F" in a hexadecimal notation, as mentioned above, so that the determination at SH06 become YES. Thus, chord counter CC is reset to 0 at SH07, the chord advancement data of the 0th chord step is again read at SH08 and the processes at SH09 and the subsequent blocks are iterated.

Therefore, when the main chord advancement data is read to its final chord step, this chord step is not read and control returns to the 0th chord step to iterate the same chord advancement process.

When the step where GOD=F is read in the main chord advancement picture advancement data at SK08 of FIG. 20, the determination at SK02 becomes YES. Thus, picture counter GC is reset to 0 at SK03 and the picture advancement data of the 0th step is again read at SK07 and the processes at SK08 and the subsequent blocks are iterated.

When the Tempo or Rhythm is Switched during Auto Chord Advancement Process

When the performer operates tempo up SW 1058 or tempo down SW 1059 of FIG. 3 in the auto chord advancement process, the value of tempo data register TR is changed at SA20 of FIG. 10. This process is exactly the same as the tempo process at SE02 and already shown in FIG. 12.

The operation of the apparatus performed when the rhythm is switched during the auto chord advancement process will be described next. This operation is similar to that performed when the rhythm is switched during reproduction of only the rhythm sound. A rhythm header such as that shown in FIG. 24 is stored in chord advancement memory 107 of FIG. 1, as mentioned above, in the auto chord advancement mode. If the rhythm is switched, the tempo data is also switched correspondingly. Therefore, this process is required to be added.

Namely, first, when the determination at SF07 of FIG. 15 is YES, namely, when the rhythm is switched at a timing appropriate for separating the main rhythm pattern of 16 steps, and after the determination at SF07 becomes NO in the normal mode, pattern change standby flag PTF is set to 0 at SF11. The determination at SF08 becomes YES and subsequently, the determination at SF09 becomes NO (the value of pattern register PR is 0 at present because the main rhythm pattern is involved) and control passes to SF10. Here, like the operation at SG04 of FIG. 16, tempo data TD corresponding to the rhythm number set in rhythm number register RR is set in tempo data register TR at SF10 of FIG. 15. After this process, pattern change standby flag PTF is set to 0 at SF11 as in the normal mode to terminate the various switching processes of FIG. 10.

If the rhythm is switched halfway through the main rhythm pattern of 16 steps, processes SE04→SE07→SE08→SE06 of FIG. 14 are performed in the normal mode until the timing appropriate for separation in encountered. Thus, the rhythm is generated in the main rhythm pattern before switching. When the timing appropriate for the separation is encountered, the determination at SE09 of FIG. 14 becomes YES and the determination at SE10 becomes NO, so that 0 is set in pattern change standby flag PTF to thereby switch the rhythm at SA12. When the timing appropriate for separation is encountered in the auto chord advancement process, the determination at SE08 of FIG. 14 becomes YES and the determination at SE09 then becomes YES. In addition, since the determination at SE10 becomes NO because the current value of PR is 0, control passes to SE11, where tempo data TD corresponding to a rhythm number set in rhythm number register RR is set in tempo data register TR at SF06 of FIG. 15 as in the process at SG04 of FIG. 16. Then, 0 is set in pattern change standby flag PTF at SE12.

As mentioned above, when the rhythm is switched, the contents of tempo data register TR are switched to new contents. Thereafter, the timing at which a timer clock is received is determined at SA18 of FIG. 10 in accordance with the contents of the register, and the rate at which RC of counter 103 of FIG. 1 counts up is determined at SA20.

When the rhythm is switched during generation of the main rhythm pattern of 16 steps, generation of the sound continues in the main rhythm pattern until the timing appropriate for separation is encountered in the rhythm reproduction process at SA14 of FIG. 10. Thereafter, the rhythm is changed. This applies in the main chord pattern in the bass reproduction process at SA15 and in the main chord pattern in the chord reproduction process at SA16. The main chord advancement data in the auto chord advancement process at SA12 is switched to a main chord advancement data corresponding to a new rhythm number indicated by rhythm number register RR directly at SH05 of FIG. 17. When the rhythm is changed, the main chord picture advancement data in the auto chord advancement display advancement process at SA13 is similarly switched. This applies to the main chord picture advancement data in the auto chord advancement display process at SA13. When the rhythm is switched, it is immediately switched to the main chord picture advancement data corresponding to a new rhythm # indicated by rhythm register RR at SK07 of FIG. 20.

When Fill-In SW is Depressed in the Auto Chord Advancement Process

The operation of the apparatus performed when the performer depresses fill-in SW 1056 of FIG. 3 during iteration of automatic accompaniment in the auto chord advancement mode through the loop of SA10–SA21 of FIG. 10 will be described.

In the rhythm reproduction process at SA17 of FIG. 10, processes SE01→SE13→SE14→SE06 at FIG. 14 are iterated as in the normal mode. If fill-in SW 1056 is depressed, the main rhythm pattern is immediately switched to the fill-in rhythm pattern. This applies similarly to the bass pattern and chord pattern in the bass reproduction process at SA15 and in the chord reproduction process at SA16.

In contrast, the contents of advancement register SR are not changed only by depressing fill-in SW 1056 in the auto chord advancement process at SA12 and indicates the value "0" or the advancement of the main chord. In the rhythm reproduction process of FIG. 14 (SA17 of FIG. 10), the contents of SR are maintained at 0 until the final fifteenth pattern step of the fill-in rhythm pattern is encountered, so that the determination at SE14 becomes YES. Therefore, the state of the process at FIG. 17 does not change and the main chord advancement is maintained.

When the final fifteenth step of the fill-in rhythm pattern is encountered and the determination at SA14 becomes YES in the rhythm reproduction process of FIG. 14, pattern register PR is set to 0 at SE15 and the main rhythm pattern is recovered. In contrast, advancement register SR is set to 1 at SE16, so that the chord advancement data becomes fill-in chord advancement data. At SE17, SE18 the counts of chord counter CC, sound length counter OC and picture counter GC and picture sound length counter GOC are forced to be set to 0. At this time, the bass pattern and chord pattern have already returned to the main pattern in the bass reproduction process at SA15 and in the chord reproduction process at SA16 in FIG. 10.

As a result, the determination at SH01 of FIG. 17 becomes YES, and the determination at SH02 becomes YES, so that control passes to SH15, where the chord step or the 0th chord step indicated by chord counter CC and of the fill-in chord advancement data corresponding to a rhythm number indicated by rhythm number register RR is read. Thereafter, control passes in the order of SH17→SH09→SH10→SH11→SH12→SH14 to thereby set the 0th chord step of the fill-in chord advancement data, etc.

Thereafter, the same operation as in the main chord advancement data is performed. In the bass reproduction process at SA15 and in the chord advancement process at SA16 in FIG. 10, a musical scale and the type of a chord are designated with musical scale data OTD and chord name data CD of the 0th chord step based on the fill-in chord advancement data are designated in the bass reproduction process at SA15 and in the chord reproduction process at SA16 in FIG. 10. This situation continues until the pattern step for sound length data OD of the 0th step is iterated.

When the count of sound length counter OC is determined as 0 at SH01 of FIG. 17, control passes again in the order of SH01→SH02→SH15, hence the fill-in chord advancement data of the next first step is read, and thus a process for generating a sound is performed.

The above operations are iterated while the respective chord steps of the fill-in chord advancement data are being read sequentially. When the final chord step of the fill-in chord advancement data is read at SH17 of FIG. 17, the determination at SH17 becomes YES because sound length data OD is "F" in the hexadecimal notation, mentioned above. Thus, advancement register SR is returned to 0 at the next SH17 and hence the main chord advancement mode is recovered. Chord counter CC is reset to 0 at SH19, the chord advancement data of the 0th chord step of the main chord advancement data is read at SH05 and thereafter, the main chord advancement is recovered.

As mentioned above, the counts of picture counter GC and picture sound length counter GOC are forced to be set to 0 at SE18, as mentioned above, in the auto chord advancement display advancement process at SA13. As a result, when (1) the determination at SK01 of FIG. 20 becomes YES, (2) the determination at SK02 becomes NO, and (3) the determination at SK04 becomes YES, control thus passes to SK14, where the step of picture counter GC having rhythm # of the auto chord advancement fill-in picture advancement data and indicated by rhythm number register PR is read. Thereafter, control passes in the order of SK08→SK09→SK10→SK11→SK12.

When the count of picture sound length counter GOC is determined as 0 at SK01 of FIG. 20, control again advances in the order of SK01→SK14→SK12, so that the auto chord advancement fill-in picture advancement data of the first step is read, transferred to and displayed by display 115.

The above operations are iterated while the respective picture steps of the auto chord advancement fill-in picture advancement data are being sequentially read. When a picture step where picture sound length data GOD of the auto chord advancement fill-in picture advancement data is "F" is read at SK14 of FIG. 20, the determination at SK02 becomes YES. Thus, picture counter GC is returned to 0 at the next SK03 and the processes at SK04 and subsequent blocks are then iterated.

When Ending SW is Depressed in the Auto Chord Advancement Process

The operation of the apparatus performed when the performer depresses ending SW 1057 of FIG. 3 during repetition of the automatic accompaniment in the auto chord advancement mode through the loop of SA10–SA21 of FIG. 10 will be described next.

First, when ending SW 1057 is depressed at a timing appropriate for separating the main rhythm pattern of 16 chord steps, control passes in the order of SF02→SF15 of FIG. 15 and hence the value "3" is set in pattern register PR in the various switching operations at SA21 of FIG. 10. In addition, control advances in the order of SF07→SF08→SF09→SF12 to thereby reset the counts of sound length counter OC and chord counter CC to 0 and set the value "3" in advancement register SR. Control then passes to SF11, where 0 is set in pattern change standby flag PTF. Since the value of pattern change standby flag PTF is 0 in the rhythm reproduction process at SA17 of FIG. 10 due to the above operation, control passes in the order of SE03→SE19→SE21 of FIG. 14 as in the normal mode and hence the ending rhythm pattern is sequentially read, starting with the pattern step 0. This applies similarly to the bass pattern and chord pattern in the bass reproduction process at SA15 and in the chord reproduction process at SA16 in FIG. 10.

In the auto chord advancement process at SA12, control passes in the order of SH01→SH02→SH03→SH04 where the determination becomes YES and control then passes to SH13 in FIG. 17. At SH13 a process is performed for reading the chord step or the 0th chord step indicated by the count of chord counter CC from that of ending chord advancement data of FIG. 24 stored in chord advancement memory 107 of FIG. 1 and corresponding to a rhythm number indicated by the rhythm number register RR. Thereafter, control advances in the order of SH09→SH10→SH11→SH12→SH14 to set the 0th chord step of the ending chord advancement data, etc.

Thereafter, the operation is performed in exactly the same manner as in the main chord advancement data. Generation of a sound is performed in a musical scale and the type of a chord based on the ending chord advancement data in the bass reproduction process at SA15 and in the chord reproduction process at SA16 of FIG. 10.

In FIG. 20, the processes at SK02 and subsequent blocks are performed when GCO=0 and the determination at SK06 becomes YES. Therefore, control passes to SK13, where the step of the auto chord advancement ending picture advancement data, indicated by picture counter GC and having a rhythm # indicated by rhythm number register RR is read. Thereafter, control passes in the order of SK08→SK09→SK10→SK11→SK12 in a manner similar to that mentioned above to thereby increment the count of picture counter GC while displaying the ending picture.

When ending SW 1057 of FIG. 3 is depressed during execution of the main rhythm pattern of 16 chord steps, control passes in the order of SF02→SF15 of FIG. 15 in the various switching operations at SA21 of FIG. 10 to set the value "3" in pattern register PR. At this time, since the count of rhythm counter 103 is not 0, control passes to SF16, where pattern change standby flag PTF is set to 1.

Since the value of pattern change standby flag PTF is 1 by the above operation in the rhythm reproduction process at SA17 of FIG. 10, control passes in the order of SE03→SA19→SA20 as in the normal mode to read a step of the main rhythm pattern. This applies to the bass pattern and the chord pattern in the bass reproduction process at SA15 and the chord reproduction process at SA16 in FIG. 10.

Since the value of advancement register SR is still 0 and shows the main chord advancement in the auto chord advancement process at SA12, reading the main chord advancement data continues. Therefore, in the bass reproduction process at SA15 and in the chord reproduction process SA16 in FIG. 10, a musical scale and the kind of a chord are designated and generated as a sound by musical scale data OTD and chord name data CD of each chord step based on the main chord advancement data.

Automatic accompaniment process is iterated through the loop of SA10–SA21 of FIG. 10. When the count of rhythm counter 103 of FIG. 1 becomes 15 in SE08 of FIG. 14, the determination at SE08 of FIG. 14 becomes YES, and thus control passes from SA08 to SE09. Since the value of pattern register PR is 3 at SF12 of FIG. 15, the determination at SE10 becomes YES, so that control passes in the order of SE24→SE25→SE26 to set the value "3" in advancement register SR and to reset sound length counter OC, chord counter CC, picture counter GC, and picture sound length counter GOC to 0. Control then passes to SE12 to set pattern change standby flag PTF to 0.

After the above processing, since the value of pattern change standby flag PTF becomes 0 in the rhythm reproduction process at SA17 of FIG. 10, control passes in the order of SE03→SE19→SE21 to sequentially read the ending rhythm patterns. This applies to the bass pattern and chord pattern in the bass reproduction process at SA15 and in the chord reproduction process at SA16 in FIG. 10. In the auto chord advancement process at SA12, controls passes in the order of SH01→SH02→SH03→SH04 in FIG. 17 and the determination at SH04 can become YES. At this time, control passes to SH13 to read the ending chord advancement data. In the bass reproduction process at SA15 and in the chord reproduction process at SA16 in FIG. 10, a sound is generated in a musical scale and the type of a chord based on the ending chord advancement data.

Automatic accompaniment process is iterated through the loop of SA10→SA21 of FIG. 10. When the count of rhythm counter 103 of FIG. 1 becomes 15, namely, when a rhythm pattern to be generated as the next other sound becomes the final fifteenth step, the determination at SE22 becomes YES and the final step of the ending rhythm pattern is generated as a sound at SE23.

After this operation, control jumps to SF20 through the route (3) of FIG. 15 in the various switching processes at SA21 of FIG. 10 from SE23. The advancement of the ending chord is forced to be terminated together with the termination of the ending rhythm pattern. Since the determination at SF20 of FIG. 15 becomes YES (the value of ACF in the auto chord advancement mode is 1), the various flags, counters, and registers are again initialized at SF21–SF28. Thereafter, control lumps to a process including SG06 and subsequent blocks through the route (2) of FIG. 16 to thereby terminate the automatic accompaniment. After this process, the processes at SG06–SE12 are iterated until any one of start SW 1054, introduction SW 1053 and rhythm SW 1051 of FIG. 3 is depressed. It is to be noted that rhythm number register RR and tempo data register TR are not initialized. If start SW 1054 is next depressed, automatic accompaniment starts with the rhythm number and at the tempo, maintained so far. In FIG. 16, the auto chord advancement mode is being awaited, so that auto chord advancement flag ACF and in-accompaniment flag BF remains unchanged.

When the determination at SK06 of FIG. 20 becomes YES or when 3 is set in SR, the auto chord advancement display advancement process at SA13 of FIG. 10 starts with the step of picture counter GC of the auto chord advancement ending picture advancement data and having a rhythm # indicated by rhythm number register RR at SK13. Namely, when the determinations at SF07, SF08, SF09 of FIG. 15 become YES and the processes at SF12–SF14 are then terminated, the display of the ending picture starts synchronous with the start of the ending automatic accompaniment.

The ending chord advancement picture advancement data shown in FIG. 7(B) and the ending chord shown in FIG. 24 are both made of steps 0–31 and the same in data length. Therefore, the automatic accompaniment and display of the ending are synchronized at starting and end points, so that picture display is made to the automatic accompaniment.

When Auto Chord Advancement Process is Started by Introduction SW

The operation of the apparatus performed when the performer depresses introduction SW 1053 of FIG. 3 to start the auto chord advancement process at SA12 of FIG. 10 through the loop of SG06–SG12 of FIG. 16 involved in the auto chord advancement mode process at SA09 of FIG. 10 will be described.

In this case, first, the determination at SG07 of FIG. 16 becomes YES and control passes through SG15 to SG16, so that the value "2" is set in pattern register PR and advancement register SR to result in the introduction rhythm pattern mode. Thereafter, control passes to the auto chord advancement process at SA12 of FIG. 10 as when start SW 1054 of FIG. 3 is depressed.

The automatic accompaniment is then iterated in the auto chord advancement mode through the loop of SA10–SA21 of FIG. 10. In the rhythm reproduction process at SA17 of FIG. 10, the process is iterated in the order of SE02→SE27→SE28–SE06 of FIG. 14 as in the normal mode to start the automatic accompaniment in the introduction rhythm pattern, which is iterated for 16 pattern steps. When the count CR of rhythm counter 103 of FIG. 1 becomes 15, the determination at SE28 becomes YES and pattern register PR is set to 0 at SA29. Thereafter, it is determined at SE30 whether AFF=1. If the auto chord advancement mode is involved, AFF=1, so that the final introduction rhythm pattern is generated as a sound at SE06 and control then involves to the main rhythm pattern. This also applies to the bass pattern and chord pattern in the bass reproduction process at SA15 and in the chord reproduction process at SA16 in FIG. 10.

Since depressing introduction SW 1053 causes the value of advancement register SR to be 2 in the auto chord advancement process at SA12, and the count of sound length counter OC is 0 at the start, as mentioned above, the determination at SH01 of FIG. 17 becomes YES. Thus, after the determination at SH02 becomes NO, the determination at SH03 becomes YES and thus control passes to SH16, where a process is performed for reading the code step or the 0th chord step indicated by the count of chord counter CC and of the introduction chord advancement data corresponding to a rhythm number # indicated by rhythm number register RR. Thereafter, control passes in the order of SH17→SH09→SH10→SH11→ SH12→SH14 to thereby set the 0th chord step of the introduction chord advancement data, etc.

Thereafter, the operation is performed in exactly the same manner as in the main chord advancement data. In the bass reproduction process at SA15 and in the chord reproduction process at SA16 in FIG. 10, a musical scale and the type of a chord are designated by musical scale data OTD and chord name data CD of the 0th chord step based on the introduction chord advancement data in the bass reproduction process at SA15 and in the chord reproduction process at SA16 in FIG. 10. This situation continues until the pattern step for sound length data OD of the 0th step is iterated.

When the count of sound length counter OC is determined as 0 at SH01 of FIG. 17, control again passes in the order of SH01→SH02→SH03→SH16 to read the introduction chord advancement data of the next first step, on the basis of which a sound generating process is performed.

When the above operation is iterated while the respective chord steps of the introduction chord advancement data are being sequentially read, and the final chord step of the introduction chord advancement data is read at SH16 of FIG. 17, sound length data OD (see FIG. 26) is "F" in the hexadecimal notation, so that the determination at SH17 becomes YES. Thus, at SH18 advancement register SR is returned to 0 and control passes to the main chord advancement mode. At SH19 chord counter CC is reset to 0, at SH20 picture counter GC and picture sound length counter GCO are reset to 0, at SH05 the chord advancement data of the 0th chord step in the main chord advancement is read and the main chord advancement is then recovered.

Since GOC=0 at the starting point of FIG. 20, the processes at SK02 and subsequent blocks are performed and the determination at SK05 becomes YES. Thus, control passes to SK15, where the step of the auto chord advancement introduction picture advancement data and indicated by picture counter GC having a rhythm number # indicated by the rhythm number register RR is read (SK13). Thereafter, control passes in the order of SK08→SK09→SK10→SK11→SK12 in a manner similar to that mentioned above, and the count of picture counter GC is incremented while the introduction picture is being displayed.

Figures 29, 30:
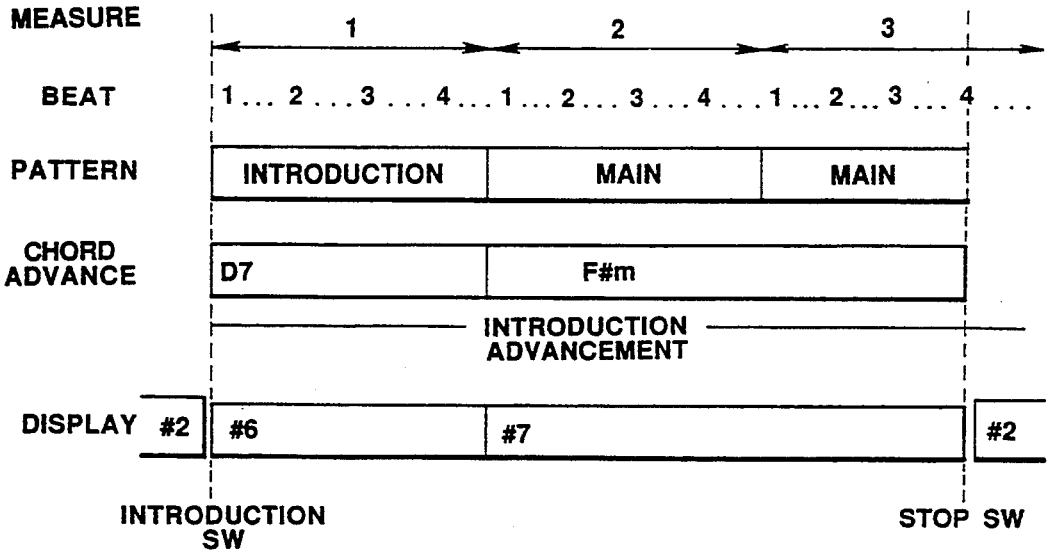
FIG. 29 shows the structure of illustrative picture advancement data for auto chord advancement introduction.
FIG. 30 shows the structure of illustrative picture advancement data in the auto chord advancement mode.

At this time, as illustrated in FIG. 29, if picture number data entities GD at steps 0 and 1 are both #6, and picture sound length data entities GOD are both 8, the total sound length of steps 0 and 1 corresponds to one measure (GOD=1 corresponds to a 16th musical scale length). Therefore, as shown in FIG. 30, the #6 picture is continuously displayed in one measure, as shown in FIG. 30. Since the picture number data entities GD are both #7 and the picture sound length data entities GOD are both 8 at steps 2–5 of FIG. 29, the total sound length of steps 2–4 corresponds to two measures. Therefore, as shown in FIG. 30, the #7 picture is displayed continuously in the second and third measures.

In FIG. 30, the initial picture #2 is displayed before the introduction SW shown by the broken lines is depressed.

When Stop SW is Depressed in the Auto Chord Advancement Process

The operation of the apparatus performed when the performer depresses stop SW 1055 of FIG. 3 during iteration of automatic accompaniment of the auto chord advancement mode through the loop of SA10–SA21 of FIG. 10 will be described next.

In the various switching processes at SA21 of FIG. 10, the determination at SF03 of FIG. 15 becomes YES and control passes to SF20, where the determination becomes YES (the value of ACF is 1in the auto chord advancement mode), so that the processes at SF21–SF28 are then performed sequentially. Thereafter, the automatic accompaniment is terminated in the manner similar to the termination of the automatic accompaniment performed when ending SW 1057 of FIG. 3 is depressed.

At this time, picture sound length counter GOC, and picture counter GC are reset to 0, the automatic accompaniment stops, and the display is then terminated in the standby state where control has passed from the route (2) of FIG. 16 to the loop of SG06–SG12.

What is claimed is:

1. An automatic performance apparatus comprising:

musical data storing means for storing a sequence of musical data representing music, said musical data including (i) musical tone data determining musical tone and (ii) timing data controlling a time interval for respective musical tones and being determined as a multiple of a standard time length;

automatic performance means for performing music automatically by reading the musical data from said musical data storing means to generate musical tones;

image data storing means for storing a plurality of image data, each of which represents a corresponding image, the image data storing means capable of accessing the image data in a random order relative to an order of reproduction of the corresponding images;

image data reading means for reading the image data in a sequence from said image data storing means;

sequence data storing means for storing sequence data indicative of the sequence in which the image data are read by said image data reading means and timing data indicative of a time interval for respective image data to be read out, said timing data being determined as a multiple of a standard time length;

variable time control means for variably determining the standard time length;

controlling means for controlling said image data reading means and automatic performance means so as to read:

(i) the image data in accordance with the sequence indicated by the sequence data stored in said sequence data storing means, said time interval for reading out respective image data being thereby varied in response to the determination of said variable time control means, and (ii) the musical data in accordance with the timing data in said musical data storing means, said time interval for reading out respective musical data being thereby varied in response to the determination of said variable time control means; and displaying means for displaying an image represented by the image data read by said image data reading means.

2. An automatic performance apparatus according to claim 1, wherein said musical data storing means stores plural kinds of musical data, said automatic performance means performs the music automatically on the basis of the musical data selected at present, said sequence data storing means stores plural kinds of sequence data, and said controlling means controls said image data reading means on the basis of the sequence data corresponding to the musical data selected at present.

3. An automatic performance apparatus comprising:

musical data storing means for storing a sequence of musical data representing music, said musical data including (i) musical tone data determining musical tone and (ii) timing data controlling a time interval for respective musical tones and being determined as a multiple of a standard time length;

automatic performance means for performing the music automatically by reading the musical data from said musical data storing means to generate musical tones;

image data storing means for storing a plurality of image data, each of which represents a plurality of images, the image data storing means capable of accessing the image data in a random order relative to an order of reproduction of the images;

timing data storing means for storing timing data indicative of timing synchronous with advancement of the music and indicative of the timing of switching respective ones of the plurality of images, said timing data being determined as a multiple of a standard time length;

first reading means for reading the timing data stored in said timing data storing means;

second reading means for reading the image data from said image data storing means on the basis of the timing data read by said first reading means;

sequence data storing means for storing sequence data indicative of the sequence in which the image data are read by said second reading means;

variable time control means for variably determining the standard time length;

controlling means for controlling said second reading means and automatic performance means so as to read:

(i) the image data in accordance with the sequence indicated by the sequence data stored in said sequence data storing means, said timing data being thereby varied in response to the determination of said variable time control means, and (ii) the musical data in accordance with the timing data in said musical data storing means, said time interval for reading out respective musical data being thereby varied in response to the determination of said variable time control means; and displaying means for displaying an image represented by the image data read by said second reading means.

4. An automatic performance apparatus according to claim 3, wherein said musical data storing means stores plural kinds of musical data, said automatic performance means performs the music automatically on the basis of the musical data selected at present, said sequence data storing means stores plural kinds of sequence data, and said controlling means controls said second reading means on the basis of the sequence data corresponding to the musical data selected at present.

5. An automatic performance apparatus according to claim 3, wherein the plurality of image data do not all represent the same image.

6. An automatic performance apparatus according to claim 4, wherein the plurality of image data do not all represent the same image.

7. An automatic accompaniment apparatus comprising:

automatic accompaniment data storing means for storing a sequence of automatic accompaniment data of a normal pattern and automatic accompaniment data of a special pattern other than the normal pattern, said automatic accompaniment data including (i) musical tone data determining musical tone and (ii) timing data controlling a time interval for respective accompaniment tones and being determined as a multiple of a standard time length;

playing means for playing an automatic accompaniment by sequentially reading the automatic accompaniment data from said automatic accompaniment data storing means to generate accompaniment tones;

instructing means for instructing said playing means to play an automatic accompaniment based on the automatic accompaniment data of the special pattern;

image data storing means for storing a plurality of image data, each of which represents a corresponding image, the image data storing means capable of accessing the image data in a random order relative to an order of reproduction of the corresponding images;

first reading means for reading the image data from said image data in a sequence from storing means;

sequence data storing means for storing plural kinds of sequence data indicative of the sequence of the image data read by said first reading means and timing data indicative of a time interval for respective image data to be read out, said timing data being determined as a multiple of a standard time length;

second reading means for reading the sequence data of a kind satisfying the instruction given by said instructing means from said sequence data storing means;

variable time control means for determining the standard time length;

controlling means for controlling said first reading means and playing means so as to read:

(i) the image data in accordance with the sequence indicated by the sequence data read by said second reading means, said time interval for reading out respective image data being thereby varied in response to the determination of said variable time control means, and (ii) the automatic accompaniment data in accordance with the timing data in said automatic accompaniment data storing means, said time interval for reading out respective automatic accompaniment data being thereby varied in response to the determination of said variable time control means; and displaying means for displaying the image which the image data read by said first reading means represents.

8. An automatic accompaniment apparatus according to claim 7, wherein said special pattern comprises any one of a fill-in pattern, introduction pattern, and ending pattern.

9. An automatic accompaniment apparatus comprising:

automatic accompaniment data storing means for storing a sequence of automatic accompaniment data of a normal pattern and automatic accompaniment data of a special pattern other than the normal pattern, said automatic accompaniment data including (i) musical tone data determining musical tone and (ii) timing data controlling a time interval for respective automatic accompaniment tones and being determined as a multiple of a standard time length;

playing means for playing an automatic accompaniment by sequentially reading the automatic accompaniment data from said automatic accompaniment data storing means to generate accompaniment tones;

instructing means for instructing said playing means to play an automatic accompaniment based on the automatic accompaniment data of the special pattern;

image data storing means for storing a plurality of image data, each of which represents a corresponding image, the image data storing means capable of accessing the image data in a random order relative to an order of reproduction of the corresponding images;

timing data storing means for storing plural kinds of timing data indicative of the timing of switching the respective images synchronous with advancement of the automatic accompaniment, said timing data being determined as a multiple of a standard time length;

first reading means for reading the timing data stored in said timing data storing means;

changing means for changing the kind of the timing data read by said first reading means in accordance with the instruction given by said instructing means;

second reading means for reading the image data from said image data storing means on the basis of the timing data read by said first reading means;

sequence data storing means for storing plural kinds of sequence data indicative of the sequence of the image data read by said second reading means;

third reading means for reading the sequence data of a kind satisfying the instruction given by said instructing means from said sequence storing means;

variable time control means for determining the standard time length;

controlling means for controlling said second reading means so as to read:

(i) the image data in accordance with the sequence indicated by the sequence data read by said third reading means, said timing data being thereby varied in response to the determination of said variable time control means, and (ii) the automatic accompaniment data in accordance with the timing data in said automatic accompaniment data storing means, said time interval for reading out respective automatic accompaniment data being thereby varied in response to the determination of said variable time control means; and displaying means for displaying the image which the image data read by said second reading means represents.

10. An automatic accompaniment apparatus according to claim 9, wherein said special pattern comprises any one of a fill-in pattern, introduction pattern, and ending pattern.

11. An automatic accompaniment apparatus comprising:

automatic accompaniment data storing means for storing a sequence of automatic accompaniment data, said automatic accompaniment data including (i) musical tone data determining musical tone and (ii) timing data controlling a time interval for respective automatic accompaniment tones and being determined as a multiple of a standard time length;

chord designating means for sequentially designating a chord for automatic accompaniment;

playing means for playing an automatic accompaniment on the basis of the automatic accompaniment data read from said automatic accompaniment data storing means and the chord designated by said chord designating means to generate accompaniment tones;

image data storing means for storing a plurality of image data, each of which represents a corresponding image, the image data storing means capable of accessing the image data in a random order relative to an order of reproduction of the corresponding images;

image data reading means for reading the image data from said image data storing means;

sequence data storing means for storing sequence data indicative of the sequence of the image data read by said image data reading means and timing data indicative of a time interval for respective image data to be read out, said timing data being determined as a multiple of a standard time length;

variable time control means for determining the standard time length;

controlling means for controlling said image data reading means so as to read:

(i) the image data in accordance with the sequence indicated by the sequence data stored in said sequence data storing means, said time interval for reading out respective image data being thereby varied in response to the determination of said variable time control means, and (ii) the automatic accompaniment data in accordance with the timing data in said automatic accompaniment data storing means, said time interval for reading out respective automatic accompaniment data being thereby varied in response to the determination of said variable time control means; and displaying means for displaying the image which the image data read by said image data reading means represents.

12. An automatic accompaniment apparatus according to claim 11, wherein said chord designating means comprises chord sequence data storing means for storing chord sequence data which represents the chord sequence of the automatic accompaniment, and sequentially designates a chord on the bases of the chord sequence data stored in said chord sequence data storing means.

13. An automatic accompaniment apparatus comprising:

automatic accompaniment data storing means for storing a sequence of automatic accompaniment data;

chord sequence data storing means for storing chord sequence data which represents the sequence of a chord for automatic accompaniment, said automatic accompaniment data including (i) musical tone data determining musical tone and (ii) timing data controlling a time interval for respective automatic accompaniment tones and being determined as a multiple of a standard time length;

chord designating means for sequentially designating the chord for automatic accompaniment on the basis of the chord sequence data read from said chord sequence data storing means;

playing means for playing an automatic accompaniment on the basis of the automatic accompaniment data read from said automatic accompaniment data storing means and the chord designated by said chord designating means to generate accompaniment tones;

image data storing means for storing a plurality of image data, each of which represents a corresponding image, the image data storing means capable of accessing the image data in a random order relative to an order of reproduction of the corresponding images;

timing data storing means for storing timing data indicative of a timing synchronous with the advancement of a chord formed by a chord sequentially designated by said chord designating means and indicative of the timing of switching the respective images, said timing data being determined as a multiple of a standard time length;

first reading means for reading the timing data from said timing data storing means;

second reading means for reading the image data from said image data storing means on the basis of the timing data read by said first reading means;

sequence data storing means for storing sequence data indicative of the sequence of the image data read by said second reading means;

variable time control means for determining the standard time length;

controlling means for controlling said second reading means so as to read:

(i) the image data in accordance with the sequence indicated by the sequence data stored in said sequence data storing means, said timing data being thereby varied in response to the determination of said variable time control means, and (ii) the automatic accompaniment data in accordance with the timing data in said automatic accompaniment data storing means, said time interval for reading out respective automatic accompaniment data being thereby varied in response to the determination of said variable time control means; and displaying means for displaying the image which the image data read by said second reading means represents.

14. An automatic accompaniment apparatus comprising:

a plurality of performance operating members;

accompaniment pattern storing means for storing a plurality of accompaniment patterns, said automatic accompaniment patterns including (i) musical tone data determining musical tone and (ii) timing data controlling a time interval for respective automatic accompaniment tones and being determined as a multiple of a standard time length;

selecting means for selecting one of the accompaniment patterns stored in said accompaniment pattern storing means;

first reading means for reading the accompaniment pattern selected by said selecting means with a predetermined timing;

chord data generating means for generating chord data conforming to the operation of any one of the plurality of performance operating members;

accompaniment sound signal generating means for generating an accompaniment sound signal on the basis of the chord data generated by said chord data generating means and the accompaniment pattern read by said first reading means;

display means;

image data storing means for storing plural kinds of image data to be displayed on said display means, each of said image data representing a corresponding image, the image data storing means capable of accessing the image data in a random order relative to an order of reproduction of the corresponding images;

image advancement data storing means for storing a plurality of image advancement data, each representing a sequence of the image data to be displayed on said display means in correspondence to the plurality of accompaniment patterns and a timing data indicative of a time interval for respective image data to be read out, said timing data being determined as a multiple of a standard time length;

second reading means for reading the image advancement data corresponding to the accompaniment pattern selected by said selecting means from said image advancement data storing means;

variable time control means for determining the standard time length;

means for sequentially reading:

(i) the image data from said image data storing means on the basis of the image advancement data read by said second reading means and feeding the read data to said display means, said time interval for reading out respective image data being thereby varied in response to the determination of said variable time control means, and (ii) the automatic accompaniment data in accordance with the timing data in said automatic accompaniment pattern storing means, said time interval for reading out respective automatic accompaniment pattern being thereby varied in response to the determination of said variable time control means.

* * * * *

UNITED STATES PATENT AND TRADEMARK OFFICE

CERTIFICATE OF CORRECTION

PATENT NO. : 5,391,828
DATED : February 21, 1995
INVENTOR(S) : TAJIMA

It is certified that error appears in the above-indentified patent and that said Letters Patent is hereby corrected as shown below:

Column 41, line 46 (claim 7), after "image data", insert --in a sequence from--;

Column 41, line 47 (claim 7), delete "in a sequence from".

Signed and Sealed this

Twenty-sixth Day of March, 1996

Bruce Lehman

*Attest:*

BRUCE LEHMAN

*Attesting Officer*

*Commissioner of Patents and Trademarks*